US010520220B2

(12) United States Patent
Hjorth et al.

(10) Patent No.: US 10,520,220 B2
(45) Date of Patent: Dec. 31, 2019

(54) HEAT EXCHANGER UNIT

(71) Applicant: GLOBAL HEAT TRANSFER ULC, Edmonton (CA)

(72) Inventors: Derek Hjorth, The Woodlands, TX (US); John Gaska, Anacortes, WA (US); Randy Vanberg, Tomball, TX (US); Kevin Visscher, Edmonton (CA); Iqbal Lotey, Fort Saskatchewan (CA); Bob Peng, Edmonton (CA)

(73) Assignee: FORUM US, INC., Houston, TX (US)

( * ) Notice: Subject to any disclaimer, the term of this patent is extended or adjusted under 35 U.S.C. 154(b) by 326 days.

(21) Appl. No.: 15/477,100

(22) Filed: Apr. 2, 2017

(65) Prior Publication Data

US 2017/0292736 A1 Oct. 12, 2017

Related U.S. Application Data

(60) Provisional application No. 62/320,606, filed on Apr. 10, 2016, provisional application No. 62/320,611, filed on Apr. 10, 2016.

(51) Int. Cl.
*F24H 3/06* (2006.01)
*E21B 43/26* (2006.01)
(Continued)

(52) U.S. Cl.
CPC ..... *F24H 3/06* (2013.01); *E21B 43/26* (2013.01); *E21B 43/267* (2013.01); *F24F 1/0007* (2013.01)

(58) Field of Classification Search
CPC ..... F28F 2009/004; F28F 9/001; F28F 9/002; F28F 2280/06; F28F 2265/28;
(Continued)

(56) References Cited

U.S. PATENT DOCUMENTS 1,833,424 A * 11/1931 Jansson ..... B60K 11/04 180/68.4
2,060,848 A 11/1936 Boyle
(Continued)

FOREIGN PATENT DOCUMENTS

| | | | |
|---|---|---|---|
| CA | 2415575 | A1 | 1/2002 |
| CA | 2963028 | A1 | 4/2016 |
| DE | 10306786 | A1 | 8/2003 |
| WO | 2016079674 | A1 | 5/2016 |

OTHER PUBLICATIONS

Enerflow 3512 frac truck brochure, L&M Radiator Inc., copyright notice dated 2011 (2 pgs).
(Continued)

*Primary Examiner* — Jianying C Atkisson
*Assistant Examiner* — Jose O Class-Quinones
(74) *Attorney, Agent, or Firm* — Patterson + Sheridan, LLP

(57) ABSTRACT

Embodiments of the disclosure pertain to a heat exchanger unit that includes a frame and at least one cooler. The cooler is associated with a respective side region of the heat exchanger unit, and the cooler has an outer surface and an inner surface. The unit can include a mount assembly for coupling the cooler to the frame. The mount assembly includes an elongated fastening member; a rigid outer ring; a rigid inner ring; and a deformable ring disposed between the rigid outer ring and the inner outer ring. The cooler may have a core end mass greater than a tank end mass.

19 Claims, 16 Drawing Sheets

(51) Int. Cl.
*E21B 43/267* (2006.01)
*F24F 1/0007* (2019.01)

(58) Field of Classification Search
CPC .... F28F 2265/30; F28F 1/0007; F28F 1/0014; F28F 2275/00; F28F 2009/222
USPC ..... 180/68.4; 248/634, 635; 62/296, 428
See application file for complete search history.

(56) References Cited

U.S. PATENT DOCUMENTS 2,273,869 A * 2/1942 Julien ..... F16F 1/3732 267/141
2,382,502 A * 8/1945 Philipp ..... F24F 1/0007 62/291
2,505,999 A 5/1950 Smith
3,113,634 A 12/1963 Watters
3,207,258 A 9/1965 D'eustachio
3,384,165 A 5/1968 Mathews
3,572,657 A 3/1971 Bradley, Jr.
3,748,997 A * 7/1973 Dean, Jr. ..... F04D 17/16 454/234
3,759,157 A 9/1973 Larkfeldt et al.
3,762,489 A * 10/1973 Proksch ..... B60R 13/0838 180/68.1
3,848,465 A 11/1974 Howell
4,116,269 A * 9/1978 Ikeda ..... F01P 3/18 123/41.49
4,139,053 A * 2/1979 Schaal ..... F01P 11/0276 165/71
4,266,602 A 5/1981 White et al.
4,294,595 A 10/1981 Bowerman
4,332,293 A 6/1982 Hiramatsu
4,348,604 A 9/1982 Thode
4,449,664 A 5/1984 Mithuhira et al.
4,481,399 A * 11/1984 Greenfield ..... B23K 33/006 219/60.2
4,747,275 A 5/1988 Amr et al.
4,821,828 A 4/1989 Schwerzler et al.
4,858,866 A * 8/1989 Werner ..... B60K 11/04 248/213.3
5,213,152 A 5/1993 Cox
5,238,052 A 8/1993 Chagnot
5,277,655 A * 1/1994 Storkan ..... B60H 1/00378 454/143
5,482,113 A 1/1996 Agonafer et al.
5,524,607 A 6/1996 Grohman et al.
5,526,871 A 6/1996 Musser et al.
5,758,860 A * 6/1998 Hanazaki ..... B60K 11/04 180/68.4
5,879,466 A 3/1999 Creger et al.
5,911,936 A * 6/1999 Hanazaki ..... B29C 45/14065 248/634
5,941,303 A 8/1999 Gowan et al.
6,020,737 A 2/2000 Wyss
6,029,345 A 2/2000 Christensen
6,126,681 A 10/2000 Van Duren et al.
6,129,056 A 10/2000 Skeel et al.
6,199,622 B1 * 3/2001 Mashio ..... B60K 11/04 165/149
6,240,774 B1 6/2001 Niki et al.
6,286,986 B2 9/2001 Grimland et al.
6,386,273 B1 5/2002 Hateley
6,389,889 B1 5/2002 Ford
6,630,756 B2 10/2003 Kern et al.
6,644,844 B2 11/2003 Neal et al.
6,681,619 B2 1/2004 Alleving et al.
6,736,197 B2 5/2004 Nozaki et al.
6,749,007 B2 6/2004 Ehlers et al.
6,749,901 B1 * 6/2004 Ghosh ..... B23K 1/0004 427/448
7,210,194 B2 5/2007 Kiern
7,669,485 B2 3/2010 Tang et al.
7,845,413 B2 12/2010 Shampine et al.
7,878,007 B2 2/2011 Campbell et al.
8,188,698 B2 5/2012 Rollins et al.
8,215,833 B2 7/2012 Kouda et al.
8,347,427 B2 1/2013 Klicpera
8,649,931 B2 2/2014 Nishizawa
8,657,227 B1 2/2014 Bayliss et al.
8,764,529 B2 7/2014 Cook et al.
9,103,193 B2 8/2015 Coli et al.
9,109,594 B2 8/2015 Pawlick
9,145,040 B2 9/2015 Markowitz et al.
9,404,417 B2 8/2016 Norrick et al.
9,587,649 B2 3/2017 Oehring
9,945,578 B2 4/2018 Vanberg et al.
9,970,720 B2 5/2018 Vanberg et al.
10,208,983 B2 2/2019 Hjorth et al.
10,281,169 B2 5/2019 Hjorth et al.
2002/0074104 A1 6/2002 Dion
2002/0079150 A1 * 6/2002 Yorwarth ..... B60K 11/04 180/68.4
2003/0183446 A1 10/2003 Shah et al.
2003/0192737 A1 * 10/2003 Han ..... F01D 25/30 181/224
2004/0053031 A1 3/2004 Beaufils et al.
2004/0200598 A1 10/2004 Hitt et al.
2005/0159846 A1 7/2005 Van Ostrand et al.
2005/0236150 A1 10/2005 Chagnot et al.
2006/0042276 A1 3/2006 Doll et al.
2006/0042278 A1 3/2006 Ludwig et al.
2007/0023172 A1 2/2007 Obrist et al.
2008/0017723 A1 1/2008 Johnson et al.
2008/0065245 A1 * 3/2008 Tang ..... H05K 7/20172 700/94
2008/0256963 A1 10/2008 Mettier
2009/0219451 A1 9/2009 Birleson et al.
2010/0028134 A1 2/2010 Slapak et al.
2010/0115771 A1 5/2010 Johnson et al.
2011/0066298 A1 3/2011 Francino et al.
2011/0192578 A1 8/2011 Lang et al.
2011/0282619 A1 11/2011 Laursen et al.
2012/0168113 A1 7/2012 Karamanos
2012/0247712 A1 * 10/2012 Schertz ..... F28F 27/00 165/41
2013/0022432 A1 1/2013 Spitler
2014/0008074 A1 1/2014 Nevison
2014/0014426 A1 * 1/2014 Lauper, Jr. ..... F01P 5/06 180/68.1
2014/0056729 A1 2/2014 Pawlick
2014/0262147 A1 * 9/2014 Pawlick ..... F28F 9/001 165/67
2014/0345835 A1 11/2014 Hwang et al.
2014/0365195 A1 12/2014 Lahiri et al.
2015/0047811 A1 2/2015 Kappelman et al.
2015/0070007 A1 3/2015 Kumiawan
2015/0251521 A1 9/2015 Brauer et al.
2015/0252661 A1 9/2015 Glass
2015/0343892 A1 12/2015 Kolhouse et al.
2015/0362207 A1 12/2015 Abiprojo et al.
2016/0025536 A1 1/2016 Madsen
2016/0146487 A1 5/2016 Zywiak et al.
2016/0186649 A1 6/2016 Rollinger et al.
2016/0305865 A1 10/2016 Silva et al.
2017/0016649 A1 1/2017 Ace
2017/0096885 A1 4/2017 Oehring et al.
2017/0234631 A1 8/2017 Anderl et al.
2017/0292735 A1 10/2017 Hjorth et al.
2017/0292789 A1 10/2017 Hjorth et al.
2017/0292800 A1 10/2017 Vanberg et al.
2017/0292801 A1 10/2017 Vanberg et al.
2017/0292803 A1 10/2017 Vanberg et al.
2017/0294103 A1 10/2017 Vanberg et al.
2017/0294366 A1 10/2017 Vanberg et al.
2018/0003532 A1 1/2018 Vanberg et al.

(56) References Cited

U.S. PATENT DOCUMENTS

| | | | |
|---|---|---|---|
| 2018/0209752 | A1 | 7/2018 | Vanberg et al. |
| 2018/0209827 | A1 | 7/2018 | Vanberg et al. |

OTHER PUBLICATIONS

World Academy of Science, Engineering and Technology, vol. 6 Nov. 28, 2012, "CFD Modeling of a Radiator Axial Fan for Air Flow Distribution", date of publication indicated as 2012 (6 pgs).
Canadian Office Action dated Jul. 6, 2018 for Application No. 2,963,572.
Canadian Office Action dated Apr. 26, 2018 for Application No. 2,963,568.
Canadian Office Action dated Feb. 8, 2019 for Application No. 2,969,703.
Canadian Office Action dated Jul. 25, 2018 for Application No. 2,971,746.
Canadian Office Action dated Oct. 12, 2018 for Application No. 2,979,845.
Canadian Office Action dated Nov. 15, 2018 for Application No. 3,022,969.
Canadian Office Action dated Feb. 12, 2019 for Application No. 3,030,718.
International Search Report and Written Opinion dated Jul. 5, 2018 for Application No. PCT/IB2018/052269.
International Search Report and Written Opinion dated Dec. 17, 2018 for Application No. PCT/IB2018/057065.

* cited by examiner

HEAT EXCHANGER UNIT

CROSS-REFERENCE TO RELATED APPLICATIONS

This application claims the benefit under 35 U.S.C. § 119(e) of U.S. Provisional Patent Application Ser. No. 62/320,606, filed on Apr. 10, 2016, and of U.S. Provisional Patent Application Ser. No. 62/320,611, filed on Apr. 10, 2016. The entirety of each application being incorporated herein by reference for all purposes.

STATEMENT REGARDING FEDERALLY SPONSORED RESEARCH OR DEVELOPMENT

Not Applicable.

BACKGROUND

Field of the Disclosure

This disclosure generally relates to a heat exchanger unit with characteristics of improved: airflow, noise reduction, cooling efficiency, and/or structural integrity. More specifically, the disclosure relates to a heat exchanger unit used in connection with equipment found in an industrial setting. In particular embodiments, the heat exchanger unit may be used for cooling various utility fluids used with a heat generating device, such as an engine, a pump, or a genset.

Background of the Disclosure

Whether its refrigeration, hot showers, air conditioning, and so on, the function of heating and cooling is prevalent in today's residential and industrial settings. One area of relevance is the oil and gas industry, including exploration, upstream, and downstream operations where the ability to heat and/or cool is critical. Upstream operations can include drilling, completion, and production, whereas downstream operations can include refining and other related hydrocarbon processing, all of which utilize a vast amount of process equipment including that which provide heat transfer.

As the modern world continues to experience growth in population, it similarly continues to experience an increase in energy demand and consumption, and the oil and gas industry needs to respond accordingly. Although 'green' energy has experienced a gain in popularity, the dominant source of energy remains fossil fuels. Driven by demand and high prices for fossil fuels, the U.S. energy sector experienced a boom in the late 2000's and into the early 2010's, contributing to expansion in exploration and production across the country.

Quite unexpectedly various global economic factors resulted in a rapid turnaround in demand and a decrease in profit margin that left many industry related companies vying to remain in business. This has resulted in consolidation and innovation, as the reality of likely never again seeing the record highs associated with the price of oil sets in. To remain competitive, companies have begun looking at how they can be successful and profitable with a margin based on an oil price in a range of about $30-$50 per barrel.

A particular segment in the upstream area of oil and gas production pertains to fracing. Now prevalent, fracing includes the use of a plug set in a wellbore below or beyond a respective target zone, followed by pumping or injecting high pressure frac fluid into the zone. The frac operation results in fractures or "cracks" in the formation that allow valuable hydrocarbons to be more readily extracted and produced by an operator, and may be repeated as desired or necessary until all target zones are fractured.

The injection fluid, which may be mixed with chemicals, sand, acid, etc., may be pressurized and transported at high rate via one or more high pressure frac pumps, typically driven by diesel combustion engines.

FIGS. 1A and 1B together illustrate a conventional land-based fracturing operation and frac pump trailer unit. The operation 101 may include multiple frac pump units 105. Each unit 105 is typically operable with a pump 113 and engine 103 mounted or otherwise disposed thereon, and is capable of producing upwards of 15,000 psi. Suitable units 105 include those manufactured or provided by NOV, Haliburton, Magnum, Weatherford, and the like. See http://www.nov.com/Well_Service_and_Completion/Stimulation_ Equipment/Fracturing_Pump_Units.aspx.

The necessity of fracturing has progressively increased as production rates on new wells continue to decline. It is believed by some that at least 90 percent of all future wells in North America will require some degree of fracturing to increase production results, with a majority of these operations occurring in shale gas formations.

As demand continues to rise, producers have moved to unconventional sources such as the Barnett Shale, which for the first time resulted in wide reliance on horizontal drilling, leading to an increase on pumping pressures and operating times. Horizontal drilling and its associated multistage fracturing techniques are now the norm as shale formations have become the leading source of natural gas in North America. This harsher pumping environment demands stronger pumps capable of operating at extreme pressures and extended pumping intervals.

The frac pump is now part of a pumping system (or skid unit, etc.) that is typically self-contained on a transportable system, such as a trailer unit 105. The system components include the engine 103 and the frac pump 113, as well as a radiator (or cooler, heat exchanger, etc.) 100. Today's pumps are capable of producing 2500 BHP @ 1900 rpm while operating in standard pressure pumping well service operations in ambient conditions of about 0° F. to 125° F., and can provide upwards of 15,000 psi injection pressure at a working rate of 17 bpm. The frac pump 113 provides pressurized fluid into well(s) 191 via transfer (injection) lines 190.

But there are several drawbacks to this modern equipment. First, the operational requirements have driven the associated equipment to become massive in weight, and single trailer units sometimes exceed 80,000 lbs. Unfortunately the trailer unit 105 must comply with federal, state, and local regulation, where a number of regulators are starting to draw a line on weight limitations. Permits for a job site will only be issued when requirements are met.

Similarly, the operational requirements have driven the associated equipment, such as the diesel engine or radiator fan, to become huge point sources of noise pollution. And again, regulators are starting to draw a line on noise. This is even more problematic as job sites start to encroach closer and closer to residential areas.

Next, operational requirements have driven the associated equipment, for example the diesel engine, to become extreme generators of heat, thus requiring a larger cooling system. The typical radiator further adds significant weight to the trailer unit. And as a result of spatial constraints, the radiator 100 often lies horizontal on the bed of the trailer unit 105, as shown in FIG. 1B. The problem with this arrangement is that as the radiator fan 108 blows in ambient air to cool various service fluids ($F_1$, $F_2$, $F_3$, etc.), the air becomes progressively hot (e.g., cooling in series, where $T_{out}>T_2>T_1>T_{amb}$). See FIG. 1C. This temperature gradient results in ineffective cooling as the air is moved through the radiator 100.

The heat exchanger is typically used to cool by passing a hot service fluid through the heat exchanger along one path (or side), and passing a cooling medium through the heat exchanger along a second path (or side). In an air-cooled radiator, a fluid may circulate through the equipment and pass through the first side, and air may be drawn through the second side to cool the fluid before it returns to the equipment.

Operational requirements have further attributed to extreme conditions (e.g., temperature, pressure, vibration, etc.) that subject equipment to additional failure modes, for example, it has been found that leaks may occur at the joints of the equipment.

One type of heat exchanger is one that may be formed from a series of header bars and face bars, with plates connected between the bars to form flow paths. One or more tanks may be connected in fluid communication with either or both of a first and a second path to direct fluid flow through the respective path. In one example, in which plates are brazed to the header and face bars, and tanks welded to the ends of the heat exchangers, it was found that leaks were occurring adjacent to the header and face bars.

It was found that when the header bars and face bars were small, the heat affected zone related to a weld between the core and the tank extended past the header bars and face bars and into the brazed joint between the plates and the respective bar(s). When the weld temperature (i.e., melting point of weld material) was greater than the brazing temperature, the brazing material would melt and flow away, such that the connection at these points was either opened, or weakened, and resulted in greater likelihood of failure during operation.

FIG. 1E shows a close-up side view of part of a radiator core. A tank 177 is welded to the core 106 at the core end 106*a* (i.e., the weld point). The tank 177 has a tank end, which has an effective tank end mass. The mass of the tank (and its end) 177 is extensive (including as depending on tank wall thickness Wt), and a significant amount of heat must be applied in order to reach the weld temperature Tw at the weld point. The temperature of the melting point of the weld material Tw (typically about 1200 F) is greater than the melting point Tb (typically about 960 F) of the brazing material between the parting sheets 172 and respective bars 175 (e.g., header and face). As the tank end mass of the tank end (Mte) is larger than a core end mass of the core end (Mce), the presence of weld temperature at the weld point results in a heat profile P into the core 106 (which the profile P may be parabolic).

Heat at the weld point radiates along the easiest path. As the heat profile of temperature greater than Tb extends length 1, and is beyond the effective bar brazing length (or area A) 185 of the bar 175, the brazing material B (by having a melting temperature Tb less than weld temperature Tw) is heated and can freely flow or leach away from the area A between the bar 175 and the parting sheet 172. This results in the core 106 being susceptible to failure because upon cooling the brazing is now incomplete.

Another issue that reduces the structural integrity of the heat exchanger unit is the thermal expansion of a radiator core, particularly those made of aluminum. Typically a core is rigidly mounted without regard for how it might expand in application. However, as the core experiences expansion, it becomes prone to leaking. It was determined that a cause of the leaks was the impact of thermal expansion, with some large heat exchangers expanding by almost ½". As the cores are solidly brazed together and then hard mounted (welded or nut/bolt) to a frame, the stress from expansion caused cracking in some welds due to excessive load being applied to it.

Thermal expansion occurs, for example, when the radiator core is manufactured at ambient temperature, but is generally exposed to temperatures well above ambient during use. As a result, the material of the core will expand. As the core is normally rigidly mounted to a support structure, which resisted thermal expansion, it is believed that stresses are induced in the heat exchanger, and that failures can occur in the welds as a result.

One or more of these concerns is just as valid to non-oilfield related heat exchangers. FIG. 1D illustrates a simple schematic overview of a heat generation device (HGD) 103*a* used in a general industrial operation or setting 101*a*. The operation or setting 101*a* may be a construction site, a building, a water treatment plant, a manufacturing facility, or any other setting whereby a heat exchanger 100*a* is used for heat transfer, such as to cool (or heat) a utility fluid F that is used with the HGD 103*a*. The operation of a fan 108 results in an undesirable noise characterized by an acoustic frequency f with amplitude A1, which his readily discernable to an operator.

In an analogous manner HGD's associated with a residential setting may also have similar concerns. In other aspects, it is becoming more and more common that an industrial setting or operation is adjacent or proximate to a residential setting.

There is a need in the art to overcome deficiencies and defects identified herein. There is a particular need in the art for a heat exchanger that is readily adaptable and compatible to different pieces of heat generating equipment, such as an engine, a motor, a pump, or a genset useable in a wide range of settings.

There is a need in the art to be able to reduce pressure drop, whereby airflow through a heat exchanger can be streamlined and increased. There is a need to reduce sound emission from a heat exchanger so that it may satisfy regulatory limitations or be suitable for use in or proximate to a residential setting.

There is a need in the art for a heat exchanger that can accommodate spatial constraints, and is lighter in weight. There is a need in the art for a heat exchanger that has improved or reduced sound emissions. There is a need in the art for a heat exchanger that improves cooling efficiency. There is a need in the art for a heat exchanger with improved structural integrity, including the ability to withstand or tolerate thermal expansion and hot welding temperatures.

SUMMARY

Yet other embodiments of the disclosure pertain to a heat exchanger unit that may include a frame having one or more associated regions, such as a top region, a bottom region, and a plurality of side regions. The heat exchanger unit may have a plurality of coolers coupled with the frame. Various coolers of the plurality of coolers may be coupled with the frame proximate to a respective side region. The coolers may have an outer surface and an inner surface.

The heat exchanger unit may include one or more mount assemblies. A respective mount assembly (or sometimes 'flexible mount assembly') may be configured for the coupling of a corresponding cooler of the plurality of coolers to the frame.

The amount assembly may include an elongated fastening member; a rigid outer ring; a rigid inner ring; and a deformable ring disposed between the rigid outer ring and the inner outer ring.

In aspects, the mount assembly may include a top plate, a bottom plate, and a washer.

Any of the plurality of coolers may include a mounting slot. The elongated fastening member may extends through the rigid inner ring. The elongated fastening member may extend at least partially into and/or engage the frame.

The heat exchanger unit may include an axis, such as a vertical axis.

The heat exchanger unit may include an airflow region therein.

The heat exchanger unit may include a first set of baffles. One or more baffles of the first set of baffles may be configured (positioned, oriented, etc.) at a respective angle to the vertical axis.

The heat exchanger unit may include other sets of baffles, such as a second set of baffles, third set of baffles, fourth set of baffles, fifth set of baffles, etc. One or more baffles of the second set of baffles may be configured at a respective second angle to the vertical axis. One or more baffles of the third set of baffles may be configured at a respective third angle to the vertical axis. Other baffles of other sets may likewise be configured with a respective angle to an applicable axis.

Any of the sets of baffles may have between about one to about ten baffles. In aspects, the first set of baffles, the second set of baffles, and the third set of baffles may each have about three to about five baffles.

Any of the baffles of the heat exchanger unit may have therewith or otherwise be configured with a sound absorbing material. In aspects, any of the baffles of either of the first set of baffles, the second set of baffles, and the third set of baffles may include the sound absorbing material. The sound absorbing material may be mineral wool.

Any of the baffles of the heat exchanger unit may formed with a desired shape. For example, one or more of the baffles of the first set of baffles may have a generally isosceles trapezoidal shape.

Any of the baffles of the heat exchanger unit may be configured with a respective angle to an axis. The angle may be in the range of about 30 degrees to about 60 degrees.

The heat exchanger unit may include other components or features, such as a fan mount bar. The fan mount bar may extend between one of the plurality of side regions and another of the plurality of side regions. There may be a fan mounted to the fan mount bar. The fan may include a fan motor and a plurality of fan blades. The fan motor may be a hydraulic motor. The plurality of fan blades may be in the range of about 5 to about 15 fan blades, including any number therebetween.

Any of the plurality of coolers may be configured to permit airflow to pass therethrough. In aspects, operation of a fan of the heat exchanger unit may result in airflow through any of the respective plurality of coolers, into the airflow region, and out of an exhaust outlet.

The frame may include a plurality of horizontal members and vertical member configured together in a manner that results in a predetermined frame shape, such as a cube-shaped frame.

The heat exchanger unit may include a cooler. The cooler may include a first tank end welded to a core end. The mass of the first tank end may be less than the core end.

The first tank end and the core end may be welded together, such that there may be a weld between the first tank end and the core end. The weld may be a v-groove weld.

Still other embodiments of the disclosure pertain to a heat exchanger unit that may include a frame comprising an at least one side region and an at least one cooler coupled with the frame proximate to the respective side region. The heat exchanger unit may include a mount assembly (or flexible amount assembly), which may be configured for coupling (including partially coupling) the at least one cooler to the frame, The unit (or analogously the frame) may include an axis, such as a vertical axis.

The mount assembly may include an elongated fastening member; a rigid outer ring; a rigid inner ring; and a deformable ring disposed between the rigid outer ring and the inner outer ring.

The mount assembly may include a top plate, a bottom plate, and a washer.

The at least one cooler may include a mounting slot. In some aspects as pertaining to assembly and related coupling, the rigid outer ring, the rigid inner ring, and the deformable ring may be disposed within the mounting slot. In other aspects, the elongated fastening member may extend into and through the rigid inner ring. The elongated fastening member may extend at least partially into the frame.

The heat exchanger unit may include various baffles, including a first set of baffles.

Any of the baffles of the first set of baffles may be configured or otherwise positioned (mounted, etc.) at a respective first angle to the vertical axis. One or more baffles of the heat exchanger unit may include or otherwise be configured with a sound absorbing material.

The heat exchanger unit may include other sets of baffles, such as a second set of baffles, a third set of baffles, and a fourth set of baffles. Any baffles of the second set of baffles may be configured at a respective second angle to the vertical axis. Any baffles of the third set of baffles may be configured at a respective third angle to the vertical axis.

Any of the angles of the baffles may be in the range of about 30 to about 60 degrees. In aspects, each of the first angle, the second angle, and the third angle may be in the range of about 30 to about 60 degrees.

The heat exchanger unit may include other components or features, such as a tubular fan mount bar; a shroud coupled to a top surface; and an aeroring. There may be a fan mount coupled to the tubular fan mount bar. There may be a fan coupled to the fan mount. The fan may include or otherwise be associated with a fan motor. The fan motor may be a hydraulic motor.

The fan motor may be powered or otherwise driven a fluid. The fluid may be a pressurized hydraulic fluid pressurized to a range of about 2000 to about 6000 psi.

Any of the sets of baffles may be positioned a quarter wavelength below the fan. The quarter wavelength may be calculated based on a dominant acoustic frequency generated by the fan.

The fan may have or be otherwise operable with an associated axis of rotation. The axis of rotation may be substantially parallel to the vertical axis. In aspects, operation of the fan may result in airflow through the at least one cooler.

The frame may include a plurality of horizontal members and vertical member configured together in a manner forms a desired shape of the frame. In aspects, the shape of the frame may be cube-shaped.

Any cooler of the unit may have a respective first tank end welded to a core end. The respective first tank end mass of the first tank may be less than a respective core end mass of the core end.

The weld between the first tank end and the core end may be a v-groove weld.

And still other embodiments of the disclosure pertain to a heat exchanger unit that may include a frame having various regions, such as a top region, a bottom region, and plurality of side regions.

The heat exchanger unit may include one or more coolers. There may be a plurality of coolers, any of which may be coupled with the frame proximate to a respective side region. Any of the plurality of coolers may include a respective a core welded with a tank.

In aspects, any respective core may further include a core end having a core end mass. Similarly, any respective tank may further include a tank end having a tank end mass. Any, including each and every, respective core end mass may be greater than each respective tank end mass.

The heat exchanger unit may include an airflow region therein.

The heat exchanger unit may include various sets of baffles, such as a first set, second set, third set, and fourth set.

Any of the baffles of the various sets of baffles may be configured (positioned, mounted, oriented, etc.) at a respective angle to an axis of the unit (or frame). The axis may be a vertical axis. In aspects, one or more baffles of the first set of baffles may be configured at a respective first angle to the vertical axis. One or more baffles of the second set of baffles may be configured at a respective second angle to the vertical axis. One or more baffles of the third set of baffles may be configured at a respective third angle to the vertical axis. One or more baffles of the fourth set of baffles may be configured at a respective fourth angle to the vertical axis.

Any of the respective first angle, second angle, third angle, and fourth angle may be in the range of about 30 to about 60 degrees.

Any of the baffles of the heat exchanger unit may include a material capable of effecting sound. The material may be a sound absorbing material.

Any of the baffles of the heat exchanger unit may have or be otherwise formed to include a particular baffle shape. In aspects, at least one baffle may have a generally isosceles trapezoidal shape. In other aspects, each baffle of the first set of baffles may be generally isosceles trapezoidal in shape.

Any of the baffles may include mineral wool.

Any of the various the sets of baffles of the heat exchanger unit may be positioned a quarter wavelength below a fan mounted to the outlet, the quarter wavelength being calculated based on a dominant acoustic frequency generated by a fan.

Any of the coolers of the heat exchanger unit may be configured to permit airflow to pass therethrough. In aspects, operation of the fan may results in airflow through at least one of the plurality of coolers, into the airflow region, and out of an exhaust.

The frame may include a plurality of horizontal members and vertical members configured and coupled together in a manner that forms a predetermined shape. In aspects, the shape may be a cube-shaped frame.

The heat exchanger unit may include one or more mount assemblies for coupling an at least one of the plurality of coolers to the frame.

Any respective mount assembly may include an elongated fastening member; a rigid outer ring; a rigid inner ring; and a deformable ring disposed between the rigid outer ring and the inner outer ring.

Any of the coolers of the exchanger unit may include a mounting slot. In aspects, a respective and corresponding mount assembly may include the elongated fastening member to extend into and through the rigid inner ring. The elongated fastening member may extend through the mounting slot, and at least partially into the frame.

Yet other embodiments of the disclosure pertain to a heat exchanger unit may include a frame comprising an at least one side region.

There may be a cooler coupled with the frame proximate to the at least one side region. The cooler may include a core welded with a tank.

The core may include a core end having a core end mass. The tank may include a tank end having a tank end mass. The core end mass may be greater than the respective tank end mass.

The heat exchanger unit may include a mount assembly, which may be useful for coupling, at least partially, the cooler to the frame. The mount assembly may include an elongated fastening member; a rigid outer ring; a rigid inner ring; and a deformable ring disposed between the rigid outer ring and the inner outer ring.

Any cooler of the heat exchanger unit may include a mounting slot. In aspects, the elongated fastening member of a respective mount assembly may extend, through the rigid inner ring, through the mounting slot, and at least partially into the frame.

Yet still other embodiments of the disclosure pertain to a heat exchanger unit that may include a frame having a top region, a bottom region, and a plurality of side regions. The unit may include at least one cooler. In aspects, there may be a plurality of coolers. Any of the plurality of coolers may be coupled with the frame proximate to a respective side region. Any of the plurality of coolers may include a respective core welded with a tank.

The unit (or frame) may have an associated reference axis, such as a vertical and/or horizontal axis.

There may be an airflow region within the heat exchanger unit.

The heat exchanger unit may include a tubular fan mount bar coupled between one of the plurality of side regions, and another of the plurality of side regions.

There may be a fan mount coupled to the tubular fan mount bar.

There may be a fan coupled to the fan mount. In aspects, the fan may have or otherwise include a hydraulic motor. The hydraulic motor may be powered by pressurized hydraulic fluid pressurized to a range of about 2000 to about 6000 psi.

The fan may be operable to pull airflow through any of the plurality of coolers and into the airflow region. Any of the respective cores may have a core end mass. Any of the respective tanks may have a tank end mass. In aspects, any respective core end mass may be greater than each respective tank end mass. In aspects, any core may have a first tank end welded thereto, and a second tank end welded thereto.

The fan may have an associated axis of rotation. The axis of rotation may be substantially parallel to a reference axis, such as the vertical axis. The fan may be operable in a manner whereby operation thereof may result in airflow through at least one cooler of the unit.

The heat exchanger unit may include various sets of baffles, such as a first set, second set, third set, fourth set, etc.

Any baffle of any respective set of baffles may be coupled to the frame. Any baffle of any respective set of baffles may have a material capable of effecting sound associated therewith.

In aspects, any baffle of the first set of baffles may be coupled to the frame at an orientation of a respective first angle to the axis. Any baffle of the first set of baffles may include a sound absorbing material.

In aspects, any baffle of the second set of baffles may be coupled to the frame at an orientation of a respective second angle to the axis. Any baffle of the second set of baffles may include a sound absorbing material.

In aspects, any baffle of the third set of baffles may be coupled to the frame at an orientation of a respective third angle to the axis. Any baffle of the third set of baffles may include a sound absorbing material.

In aspects, any baffle of the fourth set of baffles may be coupled to the frame at an orientation of a respective fourth angle to the axis. Any baffle of the fourth set of baffles may include a sound absorbing material.

Any of the respective first angle, the second angle, the third angle, and the fourth angle may be in the range of about 30 to about 60 degrees.

Any respective set of baffles may be positioned a quarter wavelength below the fan, the quarter wavelength being calculated based on a dominant acoustic frequency generated by the fan during its operation.

The heat exchanger unit may include one or more mount assemblies. A respective mount assembly may be configured for the coupling of, at least partially, a corresponding cooler of the plurality of coolers to the frame. Any respective mount assembly may include various components, such as an elongated fastening member; a rigid outer ring; a rigid inner ring; a deformable ring disposed between the rigid outer ring and the inner outer ring.

Any cooler may include or be associate with one or more mounting slots. The elongated fastening member of a respective mount assembly may be configured to extend into and through the rigid inner ring, through the respective mounting slot, and/or at least partially into the frame.

Any mount assembly may include a top plate, a bottom plate, and/or a washer.

The frame of the heat exchanger unit may include one or more frame members, such as horizontal members and vertical members. In aspects, a plurality of horizontal members and vertical member coupled together in a manner that results in a desired frame shape. The desired frame shape may be a cube-shape.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
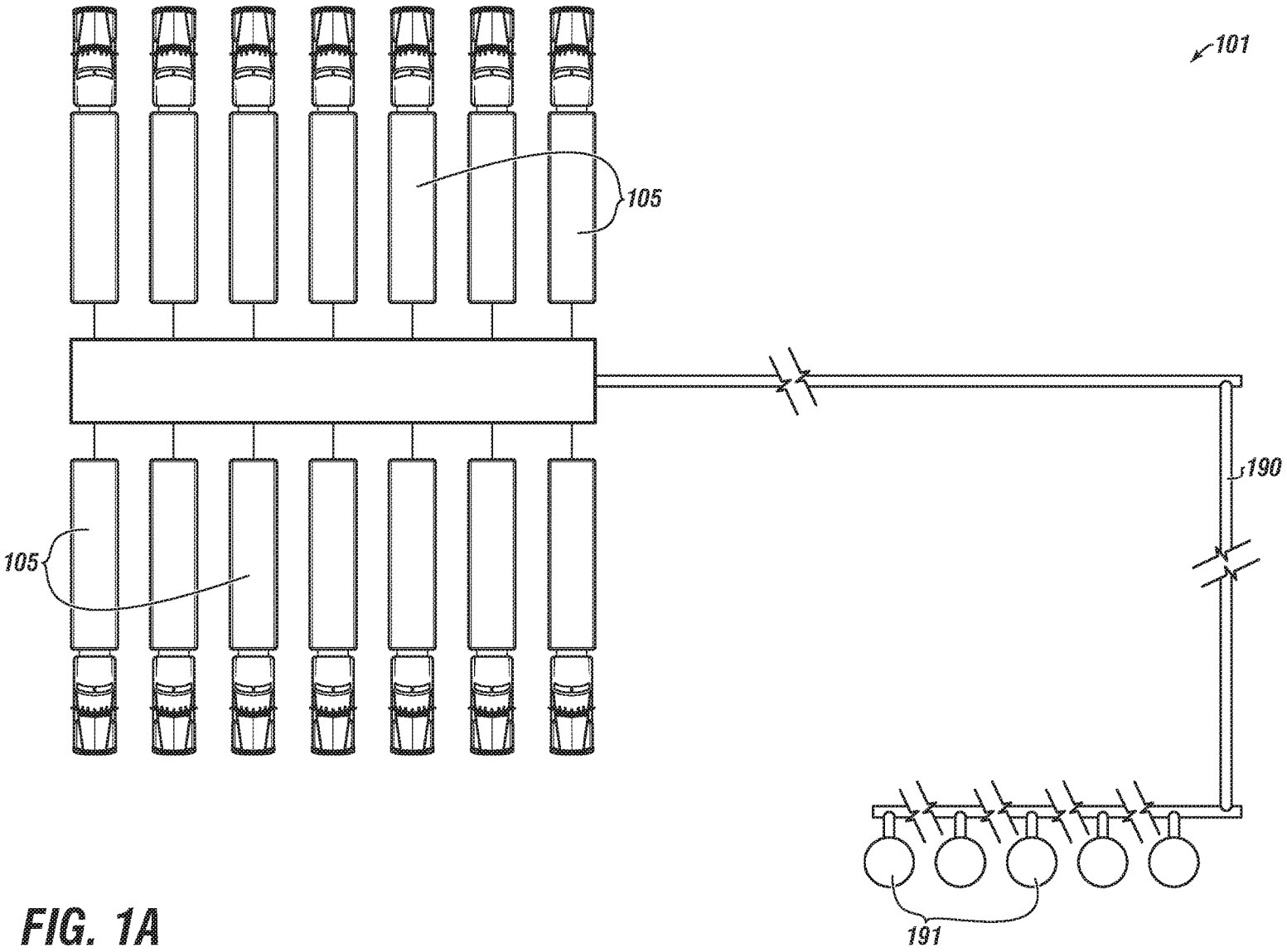
FIG. 1A (PRIOR ART)
FIG. 1A shows an overview process diagram of a conventional land-based fracturing operation.
Figure 1B:
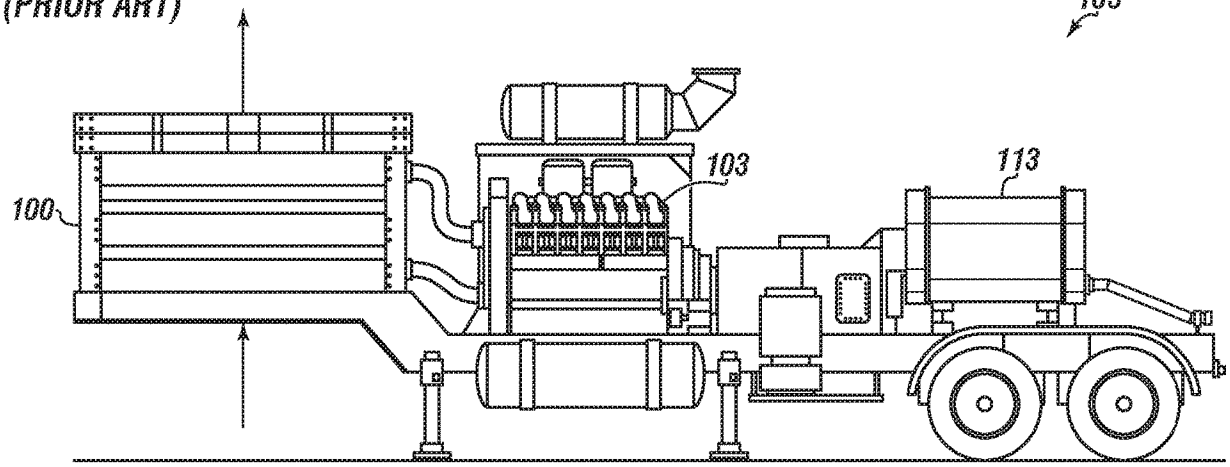
FIG. 1B (PRIOR ART)
FIG. 1B shows a side view of a frac pump truck.

Herein disclosed are novel apparatuses, systems, and methods that pertain to an improved heat exchanger, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Terms

The term "noise" as used herein can refer to a sound, including an undesirous sound.

The term "sound" as used herein can refer to a vibration(s) that travels through the air or another medium, and can be detectable or discernable to the human ear or an instrument. Sound can be referred to as a pressure wave resulting in pressure variations. A loud noise usually has a larger pressure variation and a weak one has smaller pressure variation. The more readily referred to measurement of loudness of sound is a logarithmic scale of Pascals, the decibel (dB). Sound and noise can be interchangeable, or have comparable meaning.

The term "noise absorbing material" as used herein can refer to a material having a physical characteristic of being able to reduce amplitude of a noise or sound. That is, reduce a pressure variation. 'Noise absorbing' can be interchangeable to noise reduction, noise absorbent, abatement by absorbing, and so forth. The material can be a fibrous material, such as mineral wool.

The term "noise barrier" can refer to a material or component capable of stopping noise from passing therethrough. In aspects, a noise barrier material can be adhered (such as glued) to a component. The noise barrier material can be vinyl.

The term "frequency" as used herein can refer to the rate at which a vibration (of a respective sound) occurs over a period of time. The number of pressure variations per second is called the frequency of sound, and is measured in Hertz (Hz) which is defined as cycles per second. The higher the frequency, the more high-pitched a sound is perceived.

The term "dominant acoustic frequency" can refer to a respective sound that is most discernable or noticeable to a human ear or instrument.

The term "engine" as used herein can refer to a machine with moving parts that converts power into motion, such as rotary motion. The engine can be powered by a source, such as internal combustion.

The term "motor" as used herein can be analogous to engine. The motor can be powered by a source, such as electricity, pneumatic, or hydraulic.

The term "drive" (or drive shaft) as used herein can refer to a mechanism that controls or imparts rotation of a motor(s) or engine(s).

The term "pump" as used herein can refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac pump" as used herein can refer to a pump that is usable with a frac operation, including being able to provide high pressure injection of a slurry into a wellbore. The frac pump can be operable in connection with a motor or engine. In some instances, and for brevity, 'frac pump' can refer to the combination of a pump and a driver together.

The term "frac truck" as used herein can refer to a truck (or truck and trailer) useable to transport various equipment related to a frac operation, such as a frac pump and engine, and a radiator.

The term "frac operation" as used herein can refer to fractionation of a downhole well that has already been drilled. 'Frac operation' can also be referred to and interchangeable with the terms fractionation, hydrofracturing, hydrofracking, fracking, fraccing, and frac. A frac operation can be land or water based.

The term "radiator" can also be referred to or interchangeable with the term 'heat exchanger' or 'heat exchanger panel'. The radiator can be a heat exchanger used to transfer thermal energy from one medium to another for the purpose of cooling and/or heating.

The term "cooler" as used herein can refer to a radiator made up of tubes or other structure surrounded by fins (or 'core') that can be configured to extract heat from a fluid moved through the cooler. The term can be interchangeable with 'heat exchanger panel' or comparable. Heat can also be exchanged to another fluid, such as air.

The term "cooling circuit" as used herein can refer to a cooler and respective components.

The term "core" as used herein can refer to part of a cooler, and can include multiple layers of fins or fin elements.

The term "heat exchanger unit" as used herein can refer to a device or configuration that uses multiple coolers along with other components, such as a fan, mounts, tubing, frame, and so on. The heat exchanger unit can be independent and standalone or can be directly mounted to a heat generating device. The heat exchanger unit can be operable to pull (draw) ambient air in through the coolers in order to cool one or more service fluids. The heated air is moved or blown out as a waste exhaust stream.

The term "heat generating device" (or sometimes 'HGD') as used herein can refer to an operable device, machine, etc. that emits or otherwise generates heat during its operation, such as an engine, motor, a genset, or a frac pump (including the pump and/or respective engine). The HGD can be for an industrial or a residential setting.

The term "genset" (or generator set) as used herein can refer to a 'diesel generator' or the combination of a diesel engine (or comparable) and an electric generator. The genset can convert the mechanical energy to electrical energy.

The term "baffle" as used herein can refer to a component used within a heat exchanger unit to help regulate or otherwise improve airflow therethrough. The baffle can be one-piece in nature or configured from a number of sub-components connected together. There can be a plurality of baffles, including various 'sets' of baffles. The baffle(s) can include noise absorbing material.

The term "utility fluid" as used herein can refer to a fluid used in connection with the operation of a heat generating device, such as a lubricant or water. The utility fluid can be for heating, cooling, lubricating, or other type of utility. 'Utility fluid' can also be referred to and interchangeable with 'service fluid' or comparable.

The term "mesh" as used herein can refer to a material made of a network of wire or thread, or an interlaced/interconnected structure.

The term "brazed" as used herein can refer to the process of joining two metals by heating and melting a filler (alloy) that bonds the two pieces of metal and joins them. The filler may have a melting temperature below that of the two metal pieces.

The term "welded" as used herein can refer to a process that uses high temperatures to melt and join two metal parts, which are typically the same. Such a process can refer to different types of welding, including TIG weld, metal inert gas (MIG), arc, electron beam, laser, and stir friction.

The term "deformable" as used herein can refer to an ability for a material to experience a change in shape from an original shape, such as from a force, and then substantially return to the original shape.

The term "machining" ("machine", "machined", etc.) as used herein can refer to re-machining, cutting, drilling, abrading, cutting, drilling, forming, grinding, shaping, etc. of a target piece.

The term "effective mass" as used herein can refer to the mass of part of a component, or partial mass of the component. For example, a core may have a core end, and the core end may have an effective mass, or a core end mass. The mass of the core end is less than the mass of the whole core.

The term "mounted" can refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

Embodiments of the disclosure pertain to a heat exchanger unit that may include a frame. The frame may have one or more associated regions, such as a top region, a bottom region, and a plurality of side regions. The unit may include a plurality of coolers. One or more of the plurality of coolers may be coupled with the frame proximate to a respective side region. Any of the plurality of coolers may include an outer surface and an inner surface. The heat exchanger unit may include an airflow region therein. The exchanger unit may include one or more baffles, such as a first set of baffles. One or more baffles of the first set of baffles may be configured at an angle to a reference point, which may be a vertical axis (e.g., a vertical axis of the heat exchanger unit).

The heat exchanger unit may include a second set of baffles. One or more baffles of the second set of baffles configured at a respective second angle to the vertical axis. In aspects, there may be a third set of baffles. One or more baffles of the third set of baffles may be configured at a respective third angle to the vertical axis.

One or more of the first angle, second angle, and third angle may be in the range of about 30 to about 60 degrees. In aspects the first angle, the second angle, and the third angle may be substantially the same.

One or more of the first set of baffles, the second set of baffles, and the third set of baffles may have in the range of about three to about five baffles. Any of the baffles of the heat exchanger unit may be configured to have a sound absorbing material associated therewith.

The heat exchanger unit may include a fan. The fan may be operable in a manner whereby the fan produces a point source dominant acoustic frequency. Which is to say during operation the fan may generate the point source dominant acoustic frequency. The sound absorbing material within respective baffles of the heat exchanger unit may be suitable to reduce the point source dominant acoustic frequency by at least 10 dB.

One or more baffles of the heat exchanger unit may be generally isosceles trapezoidal in shape. In aspects, each of the first set of baffles are generally isosceles trapezoidal in shape.

The sound absorbing material may be mineral wool.

The heat exchanger unit may include a fan mount bar; a shroud coupled to a top surface; and an aeroring. The fan may be mounted to the fan mount bar. The fan may include a motor and a plurality of fan blades in the range of about 8 to about 12. The fan may be associated with and/or proximate to a fan exhaust outlet.

At least one of the sets of baffles may be positioned a quarter wavelength below the fan. The quarter wavelength may be calculated based on the dominant acoustic frequency generated by the fan.

One or more coolers of the heat exchanger unit may be configured to permit airflow to pass therethrough. Operation of the fan may result in airflow through at least one of the plurality of coolers, into the airflow region, and out of the outlet.

The frame may include a plurality of horizontal members and vertical member configured together in a manner that results in a generally 'cube-shaped' frame.

Other embodiments of the disclosure pertain to a heat exchanger unit that may include a vertical axis and a frame. The frame may include one or more regions, such as a top region, a bottom region, and a plurality of side regions.

The unit may further include a plurality of coolers. At least one of the plurality of coolers may be coupled with the frame proximate to a respective side region. At least one of the plurality of coolers may have an outer surface and an inner surface.

The heat exchanger unit may have an airflow region therein.

The heat exchanger unit may include a first set of baffles. One or more baffles of the first set of baffles configured at an angle to the vertical axis, and each of the first set of baffles comprising mineral wool.

The heat exchanger unit may include a second set of baffles, and may also include a third set of baffles. One or more baffles of the second set of baffles may be configured (or positioned, oriented, etc.) at a respective second angle to the vertical axis. One or more baffles of the third set of baffles may be configured at a respective third angle to the vertical axis.

In aspects, any of the respective first angle, second angle, and third angle may be in the range of about 30 to about 60 degrees. Any of the first angle, the second angle, and the third angle may be substantially the same to each other.

Either or all of the first set of baffles, the second set of baffles, and the third set of baffles may include about one to about five baffles.

One or more of the first, second and third set of baffles may be positioned a quarter wavelength below the fan. The quarter wavelength may be calculated based on a dominant acoustic frequency generated by the fan.

The fan may be operable with an axis of rotation. The axis of rotation may be substantially parallel to the vertical axis. Operation of fan may result in airflow through one or more of the plurality of coolers, into the airflow region, and out of the top region.

The exchanger unit may include other components or features, such as a tubular fan mount bar; a shroud coupled to a top surface; and an aeroring. There may be a fan mount coupled to the tubular fan mount bar. There may be a fan coupled to the fan mount. The fan may be a hydraulic motor.

The hydraulic motor may be powered by a pressurized hydraulic fluid. The hydraulic fluid may be pressurized to a range of about 2000 to about 6000 psi. The pressurized hydraulic fluid may power the hydraulic motor by passing therethrough, and thereafter the hydraulic fluid may be cooled via one of the plurality of coolers.

The frame may include a plurality of horizontal members and vertical member configured together in a manner that results in a pre-determined frame shape, such as a cube-shaped frame.

Yet other embodiments of the disclosure pertain to a heat exchanger unit that may include a frame having one or more associated regions, such as a top region, a bottom region, and a plurality of side regions. The heat exchanger unit may have a plurality of coolers coupled with the frame. Various coolers of the plurality of coolers may be coupled with the frame proximate to a respective side region. The coolers may have an outer surface and an inner surface.

The heat exchanger unit may include one or more mount assemblies. A respective mount assembly (or sometimes 'flexible mount assembly') may be configured for the coupling of a corresponding cooler of the plurality of coolers to the frame.

The amount assembly may include an elongated fastening member; a rigid outer ring; a rigid inner ring; and a deformable ring disposed between the rigid outer ring and the inner outer ring.

In aspects, the mount assembly may include a top plate, a bottom plate, and a washer.

Any of the plurality of coolers may include a mounting slot. The elongated fastening member may extends through the rigid inner ring. The elongated fastening member may extend at least partially into and/or engage the frame.

The heat exchanger unit may include an axis, such as a vertical axis.

The heat exchanger unit may include an airflow region therein.

The heat exchanger unit may include a first set of baffles. One or more baffles of the first set of baffles may be configured (positioned, oriented, etc.) at a respective angle to the vertical axis.

The heat exchanger unit may include other sets of baffles, such as a second set of baffles, third set of baffles, fourth set of baffles, fifth set of baffles, etc. One or more baffles of the second set of baffles may be configured at a respective second angle to the vertical axis. One or more baffles of the third set of baffles may be configured at a respective third angle to the vertical axis. Other baffles of other sets may likewise be configured with a respective angle to an applicable axis.

Any of the sets of baffles may have between about one to about ten baffles. In aspects, the first set of baffles, the second set of baffles, and the third set of baffles may each have about three to about five baffles.

Any of the baffles of the heat exchanger unit may have therewith or otherwise be configured with a sound absorbing material. In aspects, any of the baffles of either of the first set of baffles, the second set of baffles, and the third set of baffles may include the sound absorbing material. The sound absorbing material may be mineral wool.

Any of the baffles of the heat exchanger unit may formed with a desired shape. For example, one or more of the baffles of the first set of baffles may have a generally isosceles trapezoidal shape.

Any of the baffles of the heat exchanger unit may be configured with a respective angle to an axis. The angle may be in the range of about 30 degrees to about 60 degrees.

The heat exchanger unit may include other components or features, such as a fan mount bar. The fan mount bar may extend between one of the plurality of side regions and another of the plurality of side regions. There may be a fan mounted to the fan mount bar. The fan may include a fan motor and a plurality of fan blades. The fan motor may be a hydraulic motor. The plurality of fan blades may be in the range of about 5 to about 15 fan blades, including any number therebetween.

Any of the plurality of coolers may be configured to permit airflow to pass therethrough. In aspects, operation of a fan of the heat exchanger unit may result in airflow through any of the respective plurality of coolers, into the airflow region, and out of an exhaust outlet.

The frame may include a plurality of horizontal members and vertical member configured together in a manner that results in a predetermined frame shape, such as a cube-shaped frame.

The heat exchanger unit may include a cooler. The cooler may include a first tank end welded to a core end. The mass of the first tank end may be less than the core end.

The first tank end and the core end may be welded together, such that there may be a weld between the first tank end and the core end. The weld may be a v-groove weld.

Still other embodiments of the disclosure pertain to a heat exchanger unit that may include a frame comprising an at least one side region and an at least one cooler coupled with the frame proximate to the respective side region. The heat exchanger unit may include a mount assembly (or flexible amount assembly), which may be configured for coupling (including partially coupling) the at least one cooler to the frame, The unit (or analogously the frame) may include an axis, such as a vertical axis.

The mount assembly may include an elongated fastening member; a rigid outer ring; a rigid inner ring; and a deformable ring disposed between the rigid outer ring and the inner outer ring.

The mount assembly may include a top plate, a bottom plate, and a washer.

The at least one cooler may include a mounting slot. In some aspects as pertaining to assembly and related coupling, the rigid outer ring, the rigid inner ring, and the deformable ring may be disposed within the mounting slot. In other aspects, the elongated fastening member may extend into and through the rigid inner ring. The elongated fastening member may extend at least partially into the frame.

The heat exchanger unit may include various baffles, including a first set of baffles.

Any of the baffles of the first set of baffles may be configured or otherwise positioned (mounted, etc.) at a respective first angle to the vertical axis. One or more baffles of the heat exchanger unit may include or otherwise be configured with a sound absorbing material.

The heat exchanger unit may include other sets of baffles, such as a second set of baffles, a third set of baffles, and a fourth set of baffles. Any baffles of the second set of baffles may be configured at a respective second angle to the vertical axis. Any baffles of the third set of baffles may be configured at a respective third angle to the vertical axis.

Any of the angles of the baffles may be in the range of about 30 to about 60 degrees. In aspects, each of the first angle, the second angle, and the third angle may be in the range of about 30 to about 60 degrees.

The heat exchanger unit may include other components or features, such as a tubular fan mount bar; a shroud coupled to a top surface; and an aeroring. There may be a fan mount coupled to the tubular fan mount bar. There may be a fan coupled to the fan mount. The fan may include or otherwise be associated with a fan motor. The fan motor may be a hydraulic motor.

The fan motor may be powered or otherwise driven a fluid. The fluid may be a pressurized hydraulic fluid pressurized to a range of about 2000 to about 6000 psi.

Any of the sets of baffles may be positioned a quarter wavelength below the fan. The quarter wavelength may be calculated based on a dominant acoustic frequency generated by the fan.

The fan may have or be otherwise operable with an associated axis of rotation. The axis of rotation may be substantially parallel to the vertical axis. In aspects, operation of the fan may result in airflow through the at least one cooler.

The frame may include a plurality of horizontal members and vertical member configured together in a manner forms a desired shape of the frame. In aspects, the shape of the frame may be cube-shaped.

Any cooler of the unit may have a respective first tank end welded to a core end. The respective first tank end mass of the first tank may be less than a respective core end mass of the core end.

The weld between the first tank end and the core end may be a v-groove weld.

And still other embodiments of the disclosure pertain to a heat exchanger unit that may include a frame having various regions, such as a top region, a bottom region, and plurality of side regions.

The heat exchanger unit may include one or more coolers. There may be a plurality of coolers, any of which may be coupled with the frame proximate to a respective side region. Any of the plurality of coolers may include a respective a core welded with a tank.

In aspects, any respective core may further include a core end having a core end mass. Similarly, any respective tank may further include a tank end having a tank end mass. Any, including each and every, respective core end mass may be greater than each respective tank end mass.

The heat exchanger unit may include an airflow region therein.

The heat exchanger unit may include various sets of baffles, such as a first set, second set, third set, and fourth set.

Any of the baffles of the various sets of baffles may be configured (positioned, mounted, oriented, etc.) at a respective angle to an axis of the unit (or frame). The axis may be a vertical axis. In aspects, one or more baffles of the first set of baffles may be configured at a respective first angle to the vertical axis. One or more baffles of the second set of baffles may be configured at a respective second angle to the vertical axis. One or more baffles of the third set of baffles may be configured at a respective third angle to the vertical axis. One or more baffles of the fourth set of baffles may be configured at a respective fourth angle to the vertical axis.

Any of the respective first angle, second angle, third angle, and fourth angle may be in the range of about 30 to about 60 degrees.

Any of the baffles of the heat exchanger unit may include a material capable of effecting sound. The material may be a sound absorbing material.

Any of the baffles of the heat exchanger unit may have or be otherwise formed to include a particular baffle shape. In aspects, at least one baffle may have a generally isosceles trapezoidal shape. In other aspects, each baffle of the first set of baffles may be generally isosceles trapezoidal in shape.

Any of the baffles may include mineral wool.

Any of the various the sets of baffles of the heat exchanger unit may be positioned a quarter wavelength below a fan mounted to the outlet, the quarter wavelength being calculated based on a dominant acoustic frequency generated by a fan.

Any of the coolers of the heat exchanger unit may be configured to permit airflow to pass therethrough. In aspects, operation of the fan may results in airflow through at least one of the plurality of coolers, into the airflow region, and out of an exhaust.

The frame may include a plurality of horizontal members and vertical members configured and coupled together in a manner that forms a predetermined shape. In aspects, the shape may be a cube-shaped frame.

The heat exchanger unit may include one or more mount assemblies for coupling an at least one of the plurality of coolers to the frame.

Any respective mount assembly may include an elongated fastening member; a rigid outer ring; a rigid inner ring; and a deformable ring disposed between the rigid outer ring and the inner outer ring.

Any of the coolers of the exchanger unit may include a mounting slot. In aspects, a respective and corresponding mount assembly may include the elongated fastening member to extend into and through the rigid inner ring. The elongated fastening member may extend through the mounting slot, and at least partially into the frame.

Yet other embodiments of the disclosure pertain to a heat exchanger unit may include a frame comprising an at least one side region.

There may be a cooler coupled with the frame proximate to the at least one side region. The cooler may include a core welded with a tank.

The core may include a core end having a core end mass. The tank may include a tank end having a tank end mass. The core end mass may be greater than the respective tank end mass.

The heat exchanger unit may include a mount assembly, which may be useful for coupling, at least partially, the cooler to the frame. The mount assembly may include an elongated fastening member; a rigid outer ring; a rigid inner ring; and a deformable ring disposed between the rigid outer ring and the inner outer ring.

Any cooler of the heat exchanger unit may include a mounting slot. In aspects, the elongated fastening member of a respective mount assembly may extend, through the rigid inner ring, through the mounting slot, and at least partially into the frame.

Yet still other embodiments of the disclosure pertain to a heat exchanger unit that may include a frame having a top region, a bottom region, and a plurality of side regions. The unit may include at least one cooler. In aspects, there may be a plurality of coolers. Any of the plurality of coolers may be coupled with the frame proximate to a respective side region. Any of the plurality of coolers may include a respective core welded with a tank.

The unit (or frame) may have an associated reference axis, such as a vertical and/or horizontal axis.

There may be an airflow region within the heat exchanger unit.

The heat exchanger unit may include a tubular fan mount bar coupled between one of the plurality of side regions, and another of the plurality of side regions.

There may be a fan mount coupled to the tubular fan mount bar.

There may be a fan coupled to the fan mount. In aspects, the fan may have or otherwise include a hydraulic motor. The hydraulic motor may be powered by pressurized hydraulic fluid pressurized to a range of about 2000 to about 6000 psi.

The fan may be operable to pull airflow through any of the plurality of coolers and into the airflow region. Any of the respective cores may have a core end mass. Any of the respective tanks may have a tank end mass. In aspects, any respective core end mass may be greater than each respective tank end mass. In aspects, any core may have a first tank end welded thereto, and a second tank end welded thereto.

The fan may have an associated axis of rotation. The axis of rotation may be substantially parallel to a reference axis, such as the vertical axis. The fan may be operable in a manner whereby operation thereof may result in airflow through at least one cooler of the unit.

The heat exchanger unit may include various sets of baffles, such as a first set, second set, third set, fourth set, etc.

Any baffle of any respective set of baffles may be coupled to the frame. Any baffle of any respective set of baffles may have a material capable of effecting sound associated therewith.

In aspects, any baffle of the first set of baffles may be coupled to the frame at an orientation of a respective first angle to the axis. Any baffle of the first set of baffles may include a sound absorbing material.

In aspects, any baffle of the second set of baffles may be coupled to the frame at an orientation of a respective second angle to the axis. Any baffle of the second set of baffles may include a sound absorbing material.

In aspects, any baffle of the third set of baffles may be coupled to the frame at an orientation of a respective third angle to the axis. Any baffle of the third set of baffles may include a sound absorbing material.

In aspects, any baffle of the fourth set of baffles may be coupled to the frame at an orientation of a respective fourth angle to the axis. Any baffle of the fourth set of baffles may include a sound absorbing material.

Any of the respective first angle, the second angle, the third angle, and the fourth angle may be in the range of about 30 to about 60 degrees.

Any respective set of baffles may be positioned a quarter wavelength below the fan, the quarter wavelength being calculated based on a dominant acoustic frequency generated by the fan during its operation.

The heat exchanger unit may include one or more mount assemblies. A respective mount assembly may be configured for the coupling of, at least partially, a corresponding cooler of the plurality of coolers to the frame. Any respective mount assembly may include various components, such as an elongated fastening member; a rigid outer ring; a rigid inner ring; a deformable ring disposed between the rigid outer ring and the inner outer ring.

Any cooler may include or be associate with one or more mounting slots. The elongated fastening member of a respective mount assembly may be configured to extend into and through the rigid inner ring, through the respective mounting slot, and/or at least partially into the frame.

Any mount assembly may include a top plate, a bottom plate, and/or a washer.

The frame of the heat exchanger unit may include one or more frame members, such as horizontal members and vertical members. In aspects, a plurality of horizontal members and vertical member coupled together in a manner that results in a desired frame shape. The desired frame shape may be a cube-shape.

Other embodiments of the disclosure pertain to a method of operating or otherwise using a heat exchanger unit of the present disclosure. The method may include the steps of assembling a heat exchanger unit that includes a plurality of horizontal members and vertical member coupled together in a manner that results in a desired frame shape. The heat exchanger unit may include one or more coolers. One or more coolers may be associated with one or more respective mount assemblies. The mount assemblies may be configured or otherwise suitable for the coupling, at least partially, of the respective cooler to the frame.

The method may include the step of associating a fan (or fan system) with the frame. The fan may be driving by a motor, which may be a hydraulic motor.

The method may include the step of operating the fan motor with a pressurized hydraulic fluid.

The method may include using one or more coolers having a respective core end welded with a first tank end. The core end may have a core end mass. The first tank end may have a tank end mass. The core end mass may be greater than the tank end mass.

The heat exchanger unit may include various sets of baffles, such as a first set, second set, third set, fourth set, etc.

Any baffle of any respective set of baffles may be coupled to the frame. Any baffle of any respective set of baffles may have a material capable of effecting sound associated therewith.

In aspects, any baffle of the first set of baffles may be coupled to the frame at an orientation of a respective first angle to the axis. Any baffle of the first set of baffles may include a sound absorbing material.

In aspects, any baffle of the second set of baffles may be coupled to the frame at an orientation of a respective second angle to the axis. Any baffle of the second set of baffles may include a sound absorbing material.

In aspects, any baffle of the third set of baffles may be coupled to the frame at an orientation of a respective third angle to the axis. Any baffle of the third set of baffles may include a sound absorbing material.

In aspects, any baffle of the fourth set of baffles may be coupled to the frame at an orientation of a respective fourth angle to the axis. Any baffle of the fourth set of baffles may include a sound absorbing material.

Any of the respective first angle, the second angle, the third angle, and the fourth angle may be in the range of about 30 to about 60 degrees.

Any respective set of baffles may be positioned a quarter wavelength below the fan, the quarter wavelength being calculated based on a dominant acoustic frequency generated by the fan during its operation.

The method may include the step of using at least one baffle within the heat exchanger unit that has a sound absorbing material therein.

The method may include the step of coupling the heat exchanger unit with a heat generating device. The heat exchanger unit and the heat generating device may be in fluid communication.

Other embodiments of the disclosure pertain to a system for cooling a fluid that may include a heat exchanger unit of the present disclosure coupled in fluid communication with at least one heat generating device. The heat exchanger unit may include a plurality of horizontal members and vertical member coupled together in a manner that results in a desired frame shape. The heat exchanger unit may include one or more coolers. One or more coolers may be associated with one or more respective mount assemblies. The mount assemblies may be configured or otherwise suitable for the coupling, at least partially, of the respective cooler to the frame.

The heat exchanger unit of the system may include a fan coupled with the frame. The fan may be operably associated with a motor, which may be a hydraulic motor. The motor may be operable via the use of a pressurized hydraulic fluid.

The heat exchanger unit of the system may include one or more coolers having a respective core end welded with a first tank end. The core end may have a core end mass. The first tank end may have a tank end mass. The core end mass may be greater than the tank end mass.

The heat exchanger unit of the system may include various sets of baffles, such as a first set, second set, third set, fourth set, etc.

Any baffle of any respective set of baffles may be coupled to the frame. Any baffle of any respective set of baffles may have a material capable of effecting sound associated therewith.

In aspects, any baffle of the first set of baffles may be coupled to the frame at an orientation of a respective first angle to the axis. Any baffle of the first set of baffles may include a sound absorbing material.

In aspects, any baffle of the second set of baffles may be coupled to the frame at an orientation of a respective second angle to the axis. Any baffle of the second set of baffles may include a sound absorbing material.

In aspects, any baffle of the third set of baffles may be coupled to the frame at an orientation of a respective third angle to the axis. Any baffle of the third set of baffles may include a sound absorbing material.

In aspects, any baffle of the fourth set of baffles may be coupled to the frame at an orientation of a respective fourth angle to the axis. Any baffle of the fourth set of baffles may include a sound absorbing material.

Any of the respective first angle, the second angle, the third angle, and the fourth angle may be in the range of about 30 to about 60 degrees.

Any respective set of baffles may be positioned a quarter wavelength below the fan, the quarter wavelength being calculated based on a dominant acoustic frequency generated by the fan during its operation.

The heat exchanger unit of the system may include at least one baffle having a sound absorbing material therein.

The system may include the heat exchanger unit coupled with at least one heat generating device.

The heat exchanger unit and the heat generating device may be in fluid communication.

There may be a plurality of heat exchanger units coupled with a respective plurality of heat generating devices.

In aspects, the heat generating device may be an engine of a frac pump. The frac pump may be associated with a mobile frac pump skid or trailer.

The system may include the frac pump in fluid communication with a wellbore.

Figure 2A:
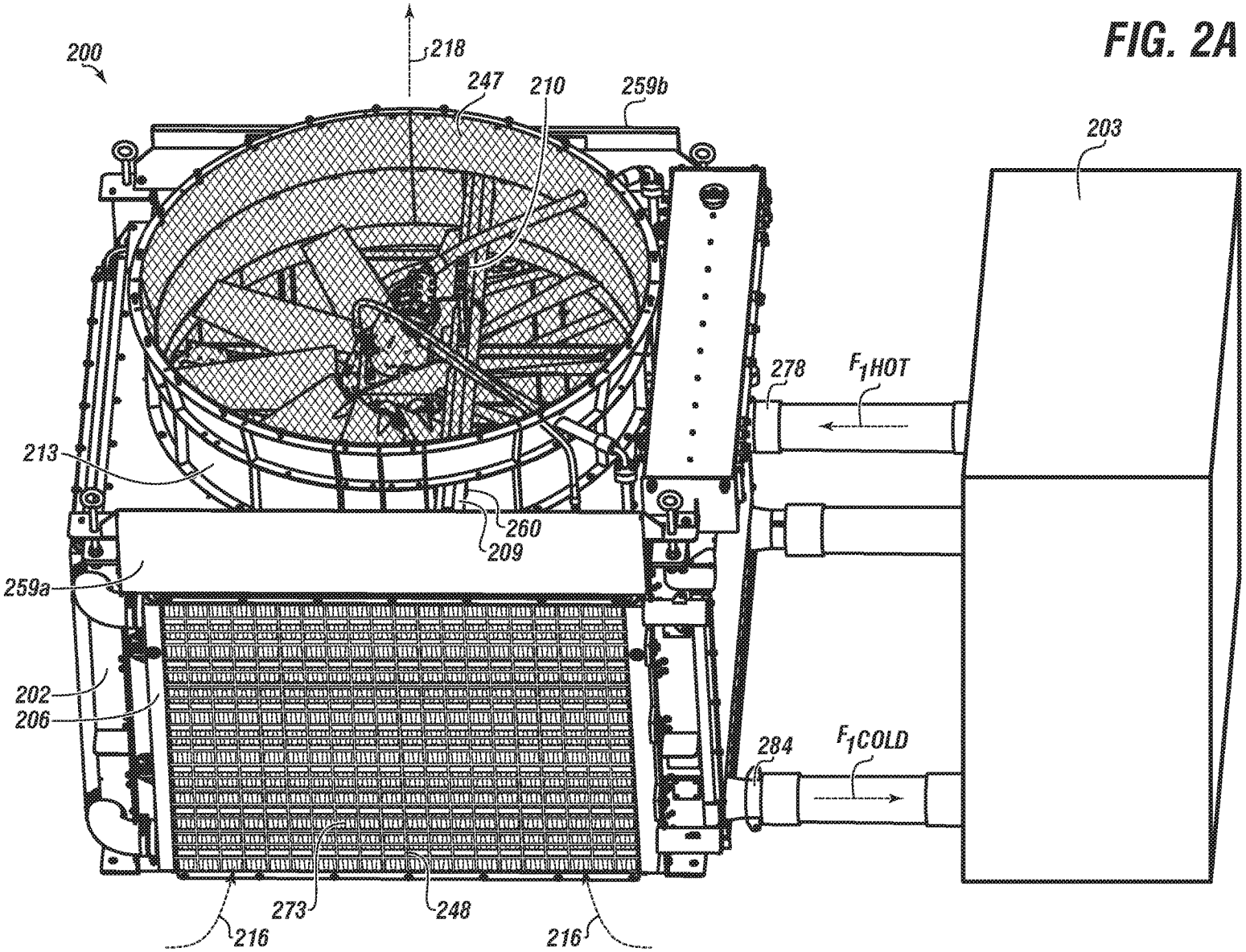
FIG. 2A shows a side view of a heat exchanger unit coupled with a heat generation device according to embodiments of the disclosure.
Figure 2B:
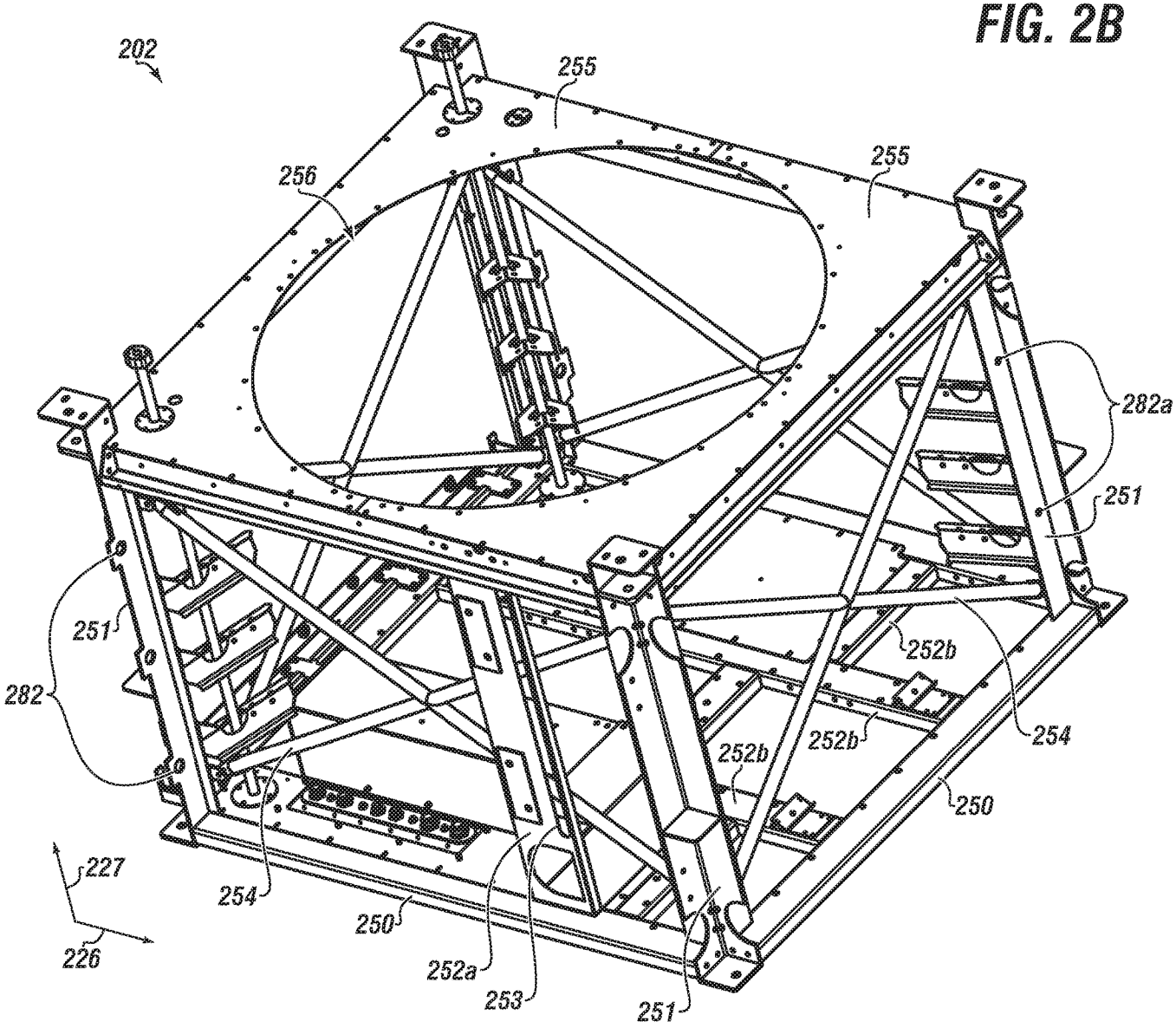
FIG. 2B shows an isometric view of a frame of the heat exchanger unit according to embodiments of the disclosure.

Referring now to FIGS. 2A and 2B together, a side view of a heat exchanger unit coupled with a heat generation device, and an isometric view of a frame of the heat exchanger unit, respectively, in accordance with embodiments disclosed herein, are shown. Embodiments herein apply to a heat exchanger unit that may be an inclusive assembly of a number of components and subcomponents. The heat exchanger unit 200 may include a solid integral frame (or skeletal frame) or may be a frame 202 that includes a number of elements arranged and coupled together, such as a plurality of horizontal elements 250 and a plurality of vertical elements 251.

Although the shape of the frame 202 need not be limited, FIG. 2B illustrates a generally cubical shape (i.e., four side regions, a top region, and a bottom region) that results from the horizontal elements 250 and the vertical elements 251 being connected at various corners and generally perpendicular to one another. Other shapes of the frame 202 could include cylindrical, hexagonal, pyramidal, and so forth. As the shape of the frame 202 may vary, so may the shape of frame elements 250, 251. It is within the scope of the disclosure that heat exchanger unit 200 may have a single side (or region), and thus a single frame side.

The frame 202 may include additional frame support plates, which may be suitable for further coupling elements 250 and 251 together, as well as providing additional surface area or contact points for which other components may be coupled therewith. One or more frame support plates 252*a* may have a generally vertical orientation, whereas one or more frame support plates 252*b* may have a generally horizontal orientation. One or more frame support plates 252 (or 252*a, b* etc.) may include a support plate slot or groove 253.

The horizontal or vertical members 250, 251 may include one or more core support mount slots 282, whereby a radiator core (or 'core') 206 may be coupled to the frame 202 via therewith. There may be a plurality of such slots 282 configured and arranged in a manner (of respective members 250 or 251) whereby a plurality of cores 206 may be coupled therewith. One or more coolers (comprising a respective core 206) may be coupled to the frame with respective mount assemblies (e.g., 1000, 1000*a* FIGS. 5A-5E). One or more cores 206 may be associated with and proximate to a respective protective grate 248, which may be useful for protecting fins of the core 206.

The frame 202 may include yet other additional support or structural elements, such as one or more frame support bars 254. The support bar(s) 254 may be coupled between various elements 250, 251, such as in a horizontal, vertical, or diagonal manner. The support bars 254 may be arranged in a 'turnbuckle' configuration. The support bar(s) 254 may be coupled to elements in a known manner, such as rivet, weld, nut-and-bolt, etc. The bars 254 may be tubular in shape, which may help improve airflow and reduce pressure drop thereacross.

The frame 202 may also include a top plate 255, which may have a top plate opening 256. The top plate opening 256 may be of a shape and size suitable for accommodating airflow therethrough. The HX unit 200 may include a fan system 257. The fan system 257 may include related subcomponents, such as a fan 208 that may be understood to include a rotating member with a plurality of fan blades 211 extending therefrom. The fan 208 may be a Multi-Wing fan from Multi-Wing International or a Horton® fan.

There may be in the range of about 4 to about 16 blades 210 attached in a generally symmetrical manner. The blades 211 may be oriented at a blade angle to the horizontal axis 226 in the range of about 10 degrees to about 50 degrees. The angle of blades 211 may be adjusted to promote optimal and efficient cooling of the HX unit 200.

The blades 211 may have an effective blade diameter in the range of about 10 inches to about 100 inches. The fan 208 may be operable by way of a suitable driver, such as a fan motor 212, which may be hydraulic, electrical, gas-powered, etc. The fan motor 212 may receive power through various power cords, conduits (e.g., conduit and cabling 258), etc., as would be apparent to one of skill in the art. The conduits 258 may be configured for the transfer of pressurized hydraulic fluid to and from the motor 212. As such, pressurized hydraulic fluid may be used to power the motor 212. The pressure of the hydraulic fluid may be in the range of about 2,000 psi to about 6,000 psi. Hydraulic fluid may exit the motor 212, and be cooled via the HX unit 200, repressurized, and recirculated back to the motor 212.

The fan 208 may operate in the range of about 200 rpm to about 1200 rpm. The fan 208 may operate in a manner to provide airflow in the range of about 10,000 cfm to about 200,000 cfm. The originating noise of the fan 208 may be the range of about 70 dB's to about 120 dB's. The frequency of noise from the fan 208 may be in the range of about 20 hz to about 20,000 hz.

Figure 6B:
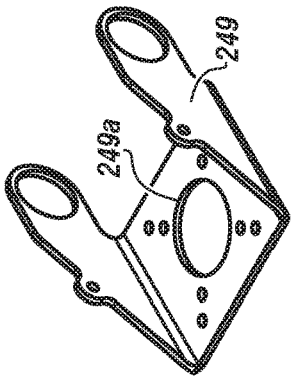
FIG. 6B shows an isometric view of a fan mount according to embodiments of the disclosure.
Figure 6A:
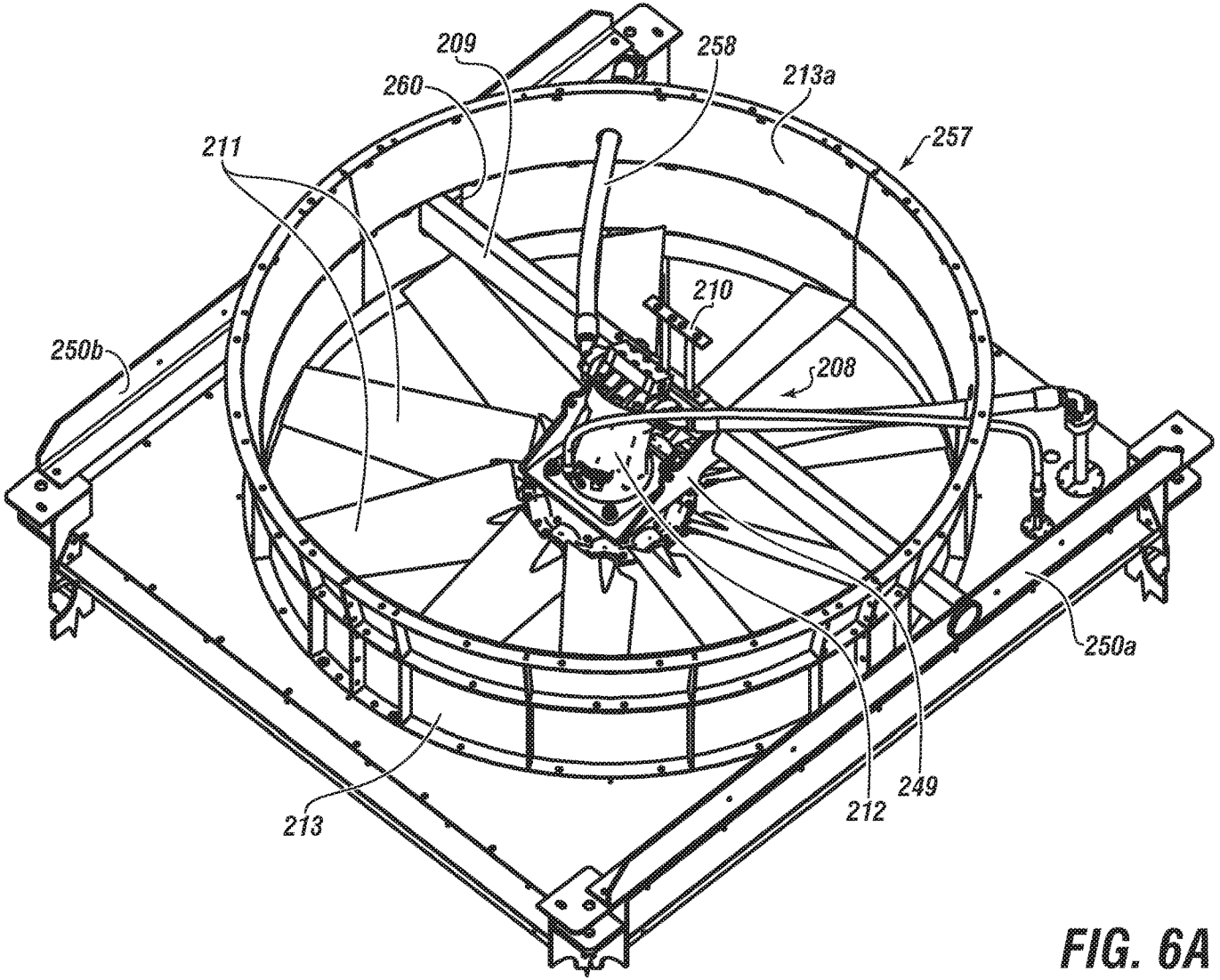
FIG. 6A shows a downward looking isometric view of a top region of a heat exchanger unit according to embodiments of the disclosure.

The frame 202 may include a fan rock guard mount 210, which may be used for the coupling of a fan rock guard 247 thereto. The frame 202 may include a fan mount plate 249. The fan mount plate 249 may include a generally planar surface for coupling with respective fan mounts of the fan 208. The fan mount plate 249 may be connected to a fan mount bar 209. The mount bar 209 may be a rigid bar or beam that extends from one side 259*a* of the HX unit 200 to another side 259*b*. The mount bar 209 may be generally cylindrical or tubular shaped, and may be integral to the frame 202 or coupled therewith. In aspects, the bar 209 may be welded to the frame 202 (such as to horizontal members 250 *a, b*—see FIG. 6A).

The fan mount bar 209 may be suitable to provide a synergistic effect of sufficient strength for supporting the fan 208, as well as have smooth surfaces that reduce noise as a result of a decrease in a pressure variation from air flowing over surface area of the bar 209. The fan 208 may have a drive that extends downwardly through fan motor slot 249*a*.

The fan system 257 may include a fan shroud 213, which may be generally annular. The fan shroud 213 may be coupled to the frame 202 via connection with the top plate 255. The rock guard 247 may be coupled to the shroud 213. The shroud 213 may include one or more lateral openings 260 to accommodate the passing of the mount bar 209 therethrough. The fan 208 may have a central rotational axis around the vertical axis 227. The shroud 213 may be positioned with respect to the central rotational axis such that fan blades 211 may be extended within desired manufacturing tolerances whereby a clearance exists between the fan blades 211 and a shroud inner surface 213*a*. The shroud 213 may be a unitary piece or the combination of multiple pieces. The size of the shroud 213, including its height and diameter may be as desired to accommodate airflow through and out of the HX unit 200.

Figure 2C:
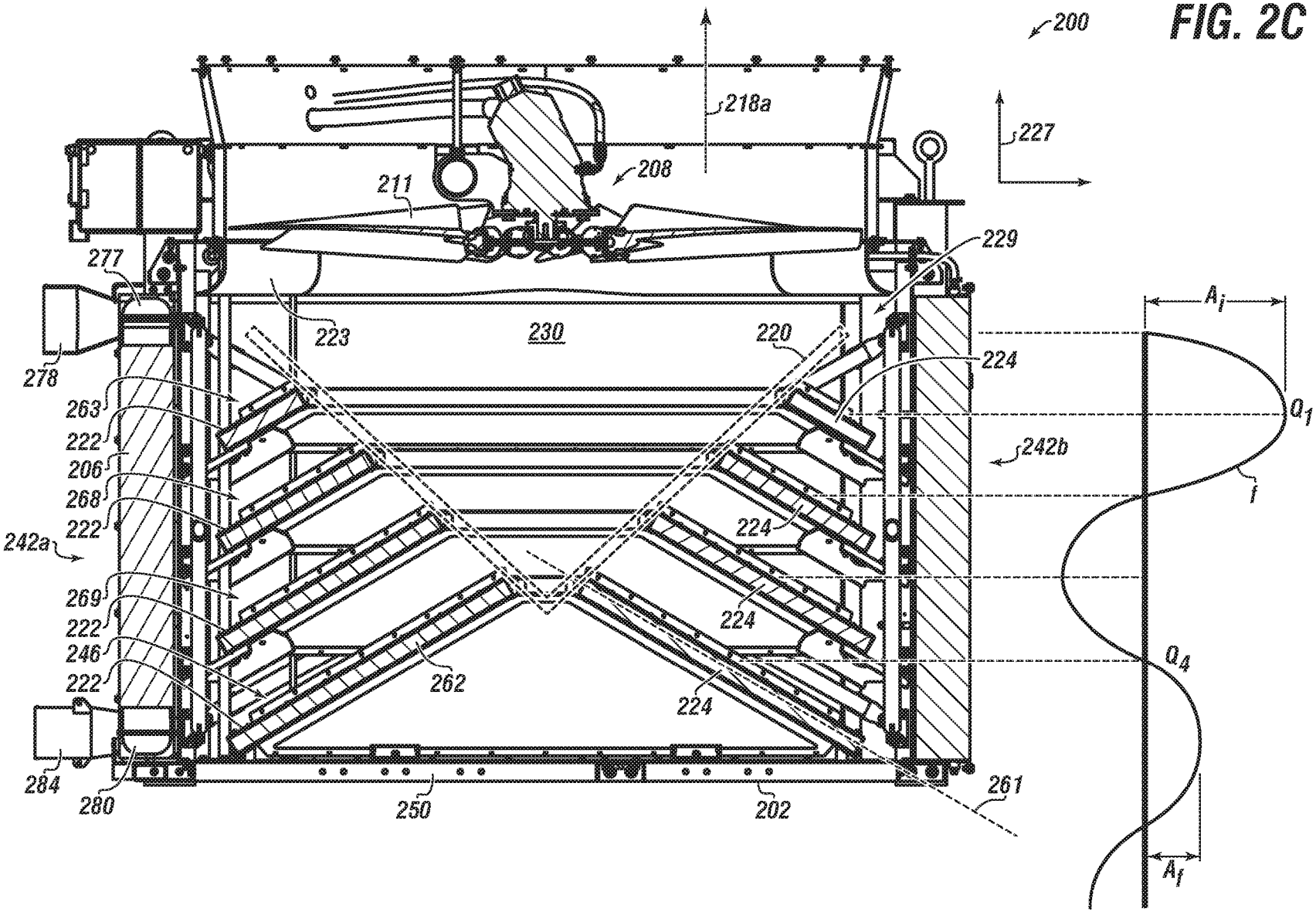
FIG. 2C shows a side cross-sectional view of an HX unit configured with a plurality of baffles according to embodiments of the disclosure.

The shroud 213 may be proximate to an aeroring (223, FIG. 2C). The aeroring (223) may be annular in nature, and have a ring cross-section that may have a radius of curvature. Thus, the aeroring (223) may have a rounded surface that may aid in improving airflow and reducing pressure in and around the fan system 257. Without the aeroring (223), eddies and other undesired airflow may occur in corners of the top of the frame 202.

The configuration of the shroud and aeroring may provide added ability for further streamlining airflow, which may beneficially reduce overall power requirements.

Figure 1C:
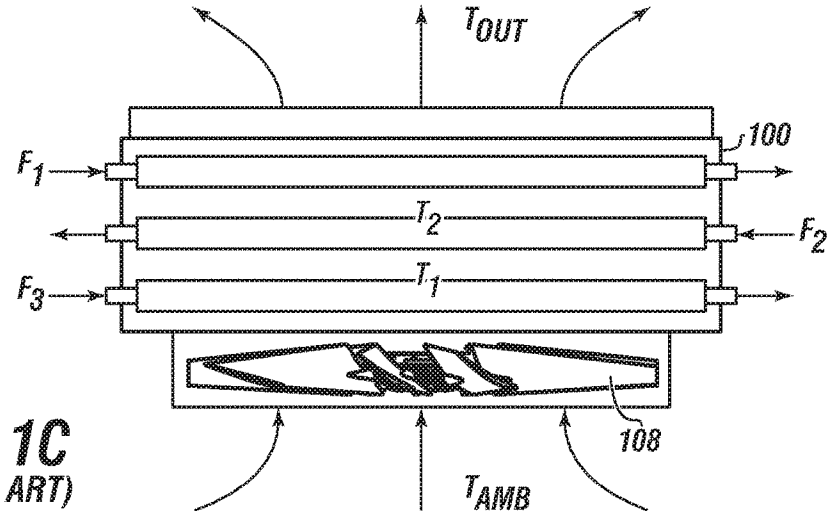
FIG. 1C (PRIOR ART)
FIG. 1C shows a close-up profile view of a horizontal heat exchanger useable with the frac pump truck of FIG. 1B.
Figure 1D:
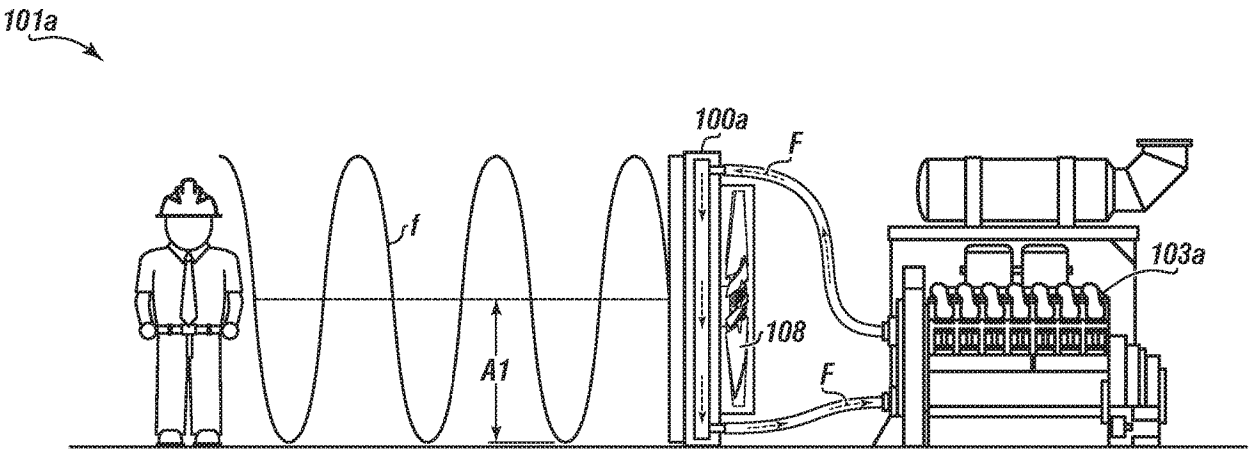
FIG. 1D (PRIOR ART)
FIG. 1D shows a simple schematic view of a heat exchanger used with a heat generation device in a general industrial setting.
Figure 1E:
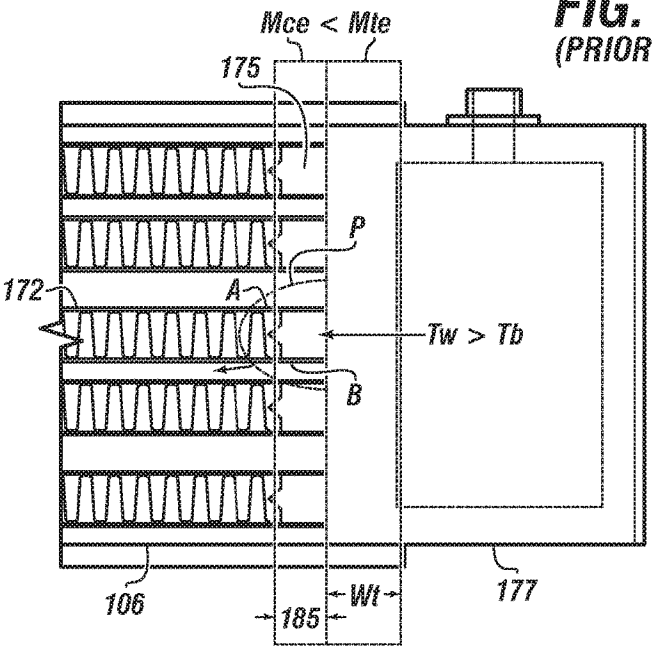
FIG. 1E (PRIOR ART)
FIG. 1E shows a close-up side view of a typical temperature profile when a tank is welded to a radiator core.

The fan system 257 can be operable to draw in and direct the flow of air 216. The air 216 may be drawn through the sides of the HX unit 200 (and respective cores, which may then be used to cool one or more utility fluids F) and out as heated exhaust 218. The benefit of such a configuration is the ability to provide cooling in parallel, versus series. In a series configuration (i.e., a typical horizontal orientation—see FIG. 1C), the airflow becomes progressively hotter as it passes through each cooling circuit, resulting in a loss in cooling efficiency. This can be especially problematic where ambient air temperature is usually hotter, like Texas and Oklahoma.

Utility fluid F (or multiple F's) may include by way of example, lube oil, jacket water, turbo (such as for an engine), transmission fluid (such as for a pump), and hydraulic fluid (such as for fan drive 212).

One of skill in the art would appreciate that airflow through the core 206 may be generally in a path parallel to horizontal axis 226. In an analogous manner, the fan 208 may have an axis of rotation generally parallel to vertical axis 227. In aspects, airflow through the core 206 may be generally perpendicular to the fan 208 axis of rotation. Accordingly, airflow through the HX unit 200 may be transitioned from (approximately) horizontal to vertical as the airflow moves through the core 206 and out the fan exhaust 218.

As such, by way of example, utility fluid $F_1$ may be transferred from a heat generating device 203 at a hot temperature into an HX unit inlet 278, cooled with airflow via core 206, and transferred out of an HX unit outlet 284 back to the HGD 203 at a cooler temperature. While not meant to be limited, HGD 203 may be an engine, a genset, a motor, a pump, or other comparable equipment that operates in a manner whereby a utility fluid is heated.

There may be one or more cores 206. A 'cooler' or 'cooling circuit' may include one or more cores 206. The HX unit 200 may have between about 1 to about 8 cooling circuits, which each may be configured for cooling in parallel to each other.

Figure 5A:
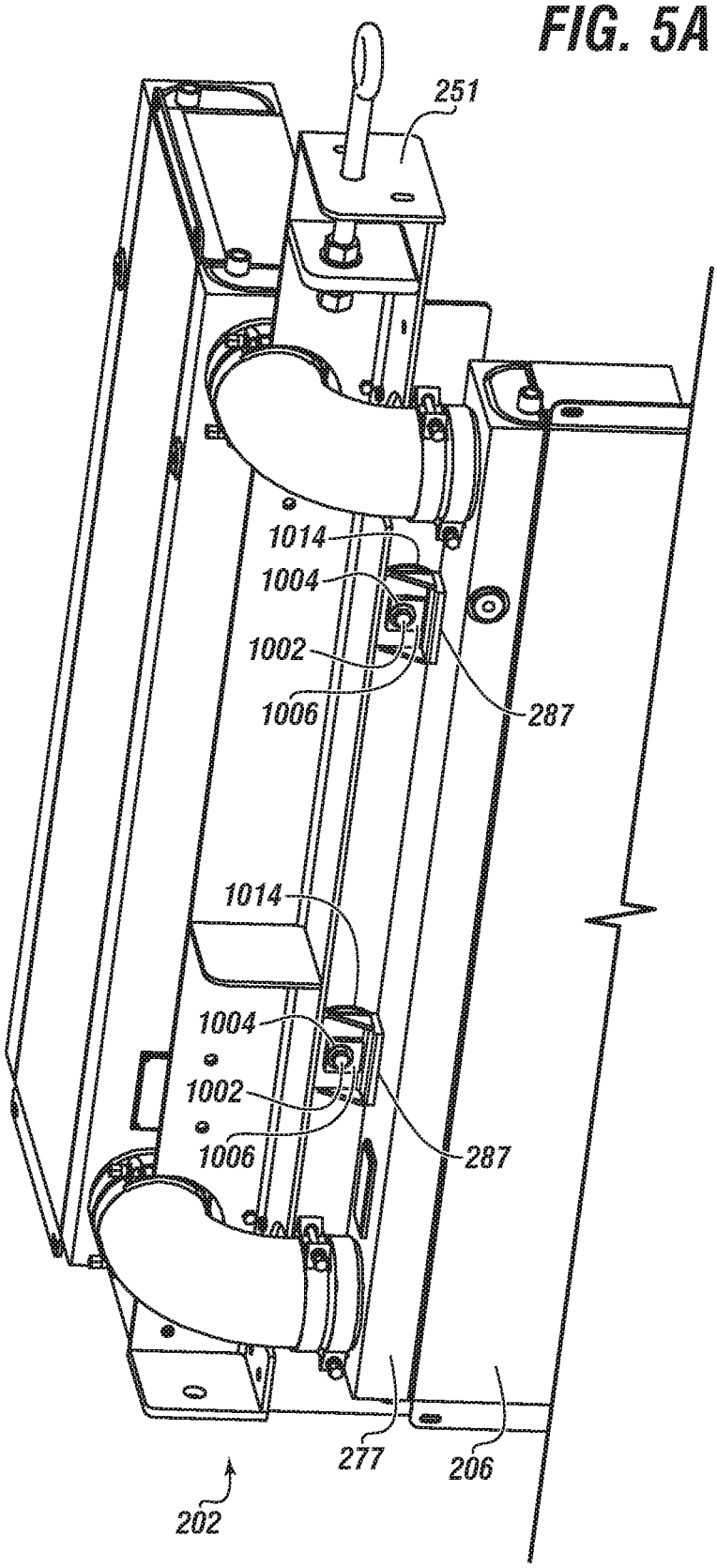
FIG. 5A shows a close-up view of a radiator core mounted to a frame of a heat exchanger unit according to embodiments of the disclosure.
Figure 5B:
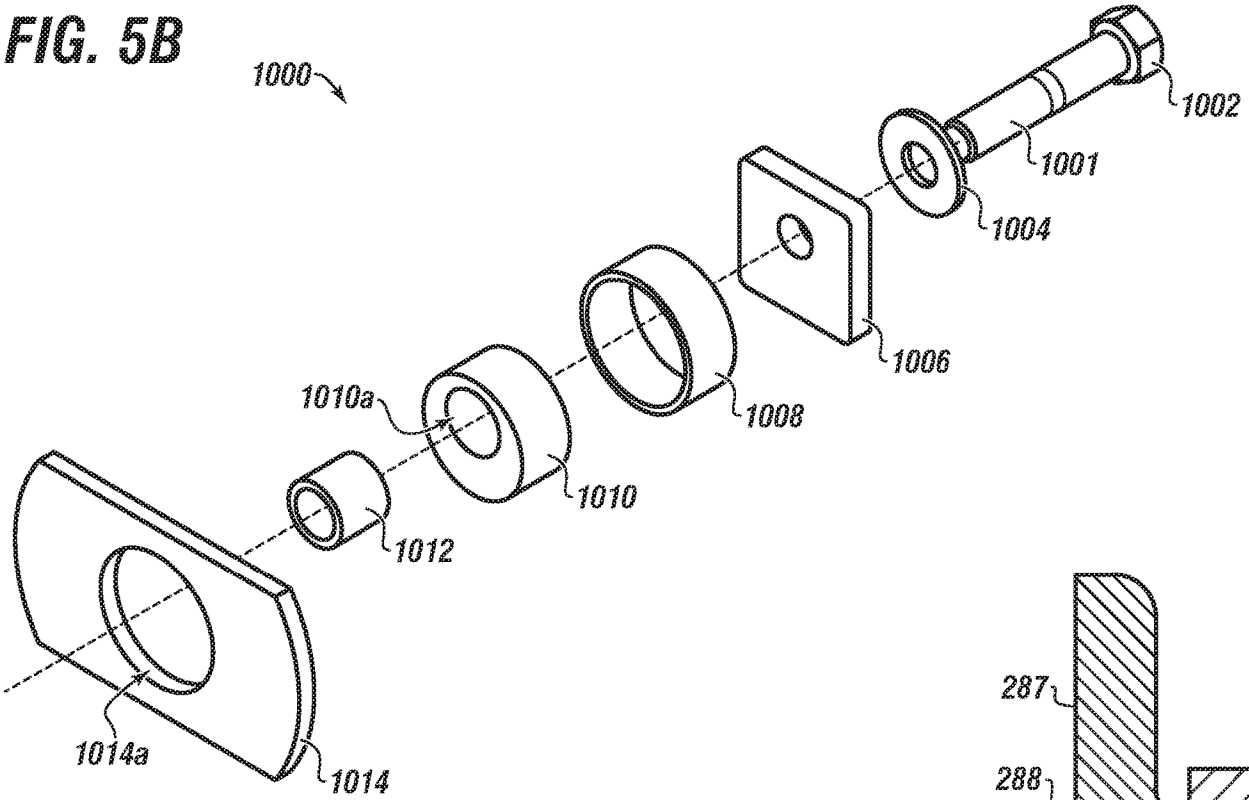
FIG. 5B shows a component breakout view of a flexible mount assembly according to embodiments of the disclosure.
Figure 5C:
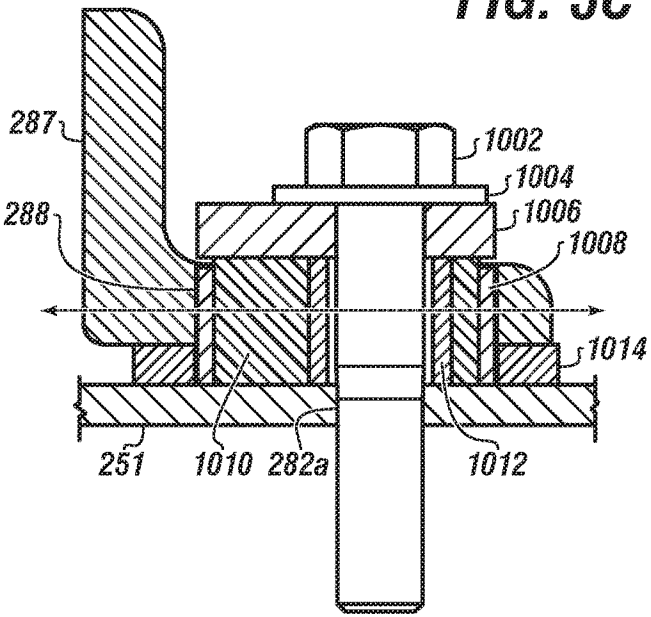
FIG. 5C shows a partial side cross-sectional view of a flexible mount assembly used with a bracket and a frame of a heat exchanger unit assembly according to embodiments of the disclosure.

Referring now to FIGS. 5A, 5B, and 5C together, a close-up view of a radiator core mounted to a frame of a heat exchanger unit, a component breakout view of a flexible mount assembly, and a partial side cross-sectional view of a flexible mount assembly used with a bracket and a frame of a heat exchanger unit, respectively, in accordance with embodiments disclosed herein, are shown.

Any cooler 204 (or core 206) of the disclosure may be mounted to a frame 202 with a flexible mount assembly 1000. The flexible mount 1000 provides for the ability to have one or more degrees of movement between the core(s) 206 and the frame 202, such as movement that may be caused by thermal expansion of the core 206. As shown, the mount assembly 1000 includes various components, including a bolt 1002 with elongated member or shaft 1001, a first washer 1004, a top plate 1006, an outer rigid ring 1008, an inner rigid (spacer) ring 1012, and a deformable ring 1010, and a bottom (or back) plate 1014 (with plate slot 1014*a*). Although not shown here, the flexible mount assembly 1000 may be coupled to the frame 202 (or also vertical member 251 and/or horizontal member 250) via a nut plate or threaded receptacle.

The core 206 may have various structure configured for coupling to the frame 202. For example, there may be one or more core mounts or core mount brackets 287, which may each have one or more core mount slots 288. The bracket 287 may be an integral piece of the core 206 formed at the time of manufacture, or may be connected therewith, such as via a welding process. In addition or alternative, there may be a bracket 287 coupled with a tank 277 of a cooler (204).

The OD of the outer rigid ring 1008, and ID's of bottom plate slot 1014*a* and core mount slot 288 may be substantially equivalent, or to the point where ring 1008 may fit (including with tight tolerance fit) within one or both of the bottom plate slot 1014*a* and core mount slot 288.

Outer ring 1008 may have an ID configured or otherwise sized in a manner whereby the deformable ring 1010 may fit therein. Similarly the deformable ring 1010 may have an ID (defined by the presence or ring slot 1010*a*) configured or otherwise sized in a manner whereby the inner rigid ring 1012 may fit therein. And each of the inner rigid ring 1012, the top plate 106, the washer 1004, and a core mount slot 282 may have a respective slot or orifice size configured to receive a bolt shaft 1002*a*, including with tight tolerance fit. The mount assembly 1000 may be matable with a mount slot 282*a* of a respective member 250 and/or 251.

The deformable ring 1010 may have a generally cylindrical shape, with the ring slot 1010*a*. The ring slot 1010*a* may be concentric with respect to the ring 1010 (e.g., see FIG. 5E), or may be eccentric. The clearance between the top plate 1006 and the bottom plate 1014 may accommodate movement of the mount 287, which may result from thermal expansion or contraction of the core 206.

The deformable ring 1010 may be of such a material that the movement in one or more vectors may be accommodated (such as laterally and axially, and so forth). As shown in FIG. 5C, the mount 287 may move back and forth along a path of the directional arrow. In aspects the deformable ring 1010 may be a rubbery material, such as neoprene. The deformable ring 1010 may have the characteristic of having an original shape, being deformed as a result of a force, and then returning (substantially or even exactly) to the original shape. The deformable ring 1010 may have excellent chemical stability and maintain flexibility over a wide temperature range. The force may be that which is incurred as a result of thermal expansion of the core 206, and thus movement of mount 287.

Figure 5D:
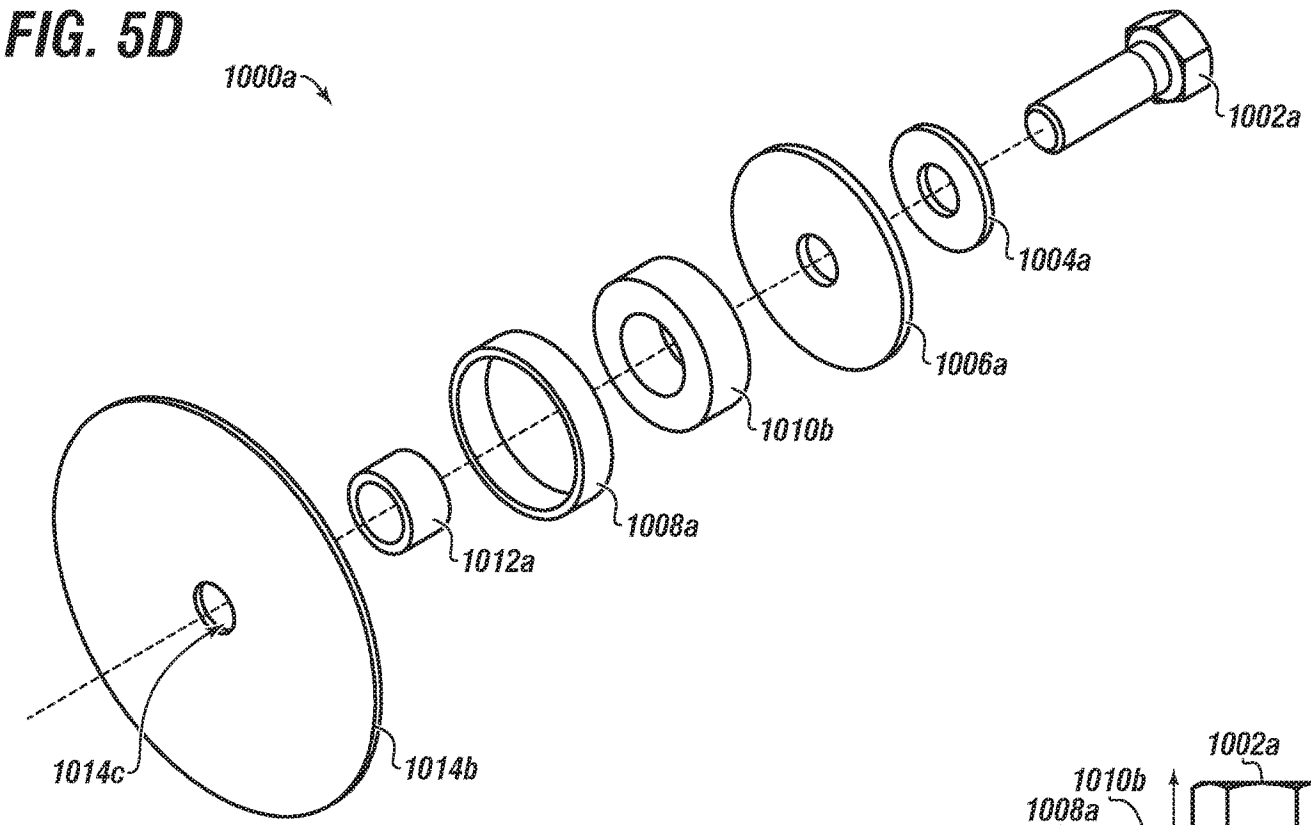
FIG. 5D shows a component breakout view of another flexible mount assembly according to embodiments of the disclosure.
Figure 5E:
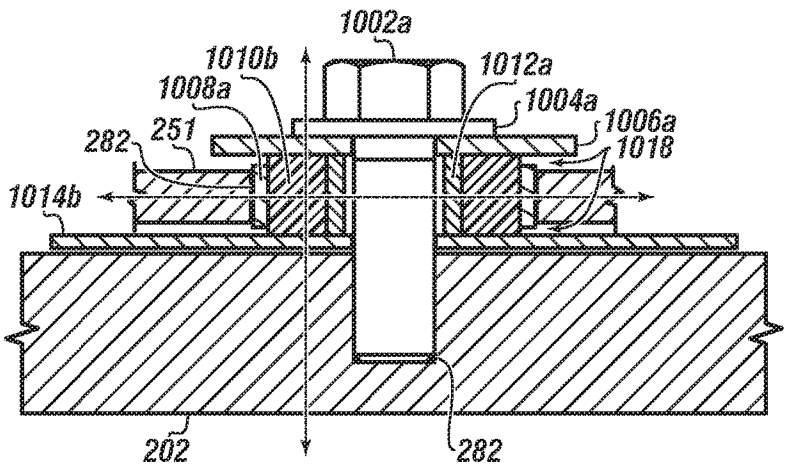
FIG. 5E shows a partial side cross-sectional view of the flexible mount assembly of FIG. 5D used with a core a heat exchanger unit according to embodiments of the disclosure.
Figure 5F:
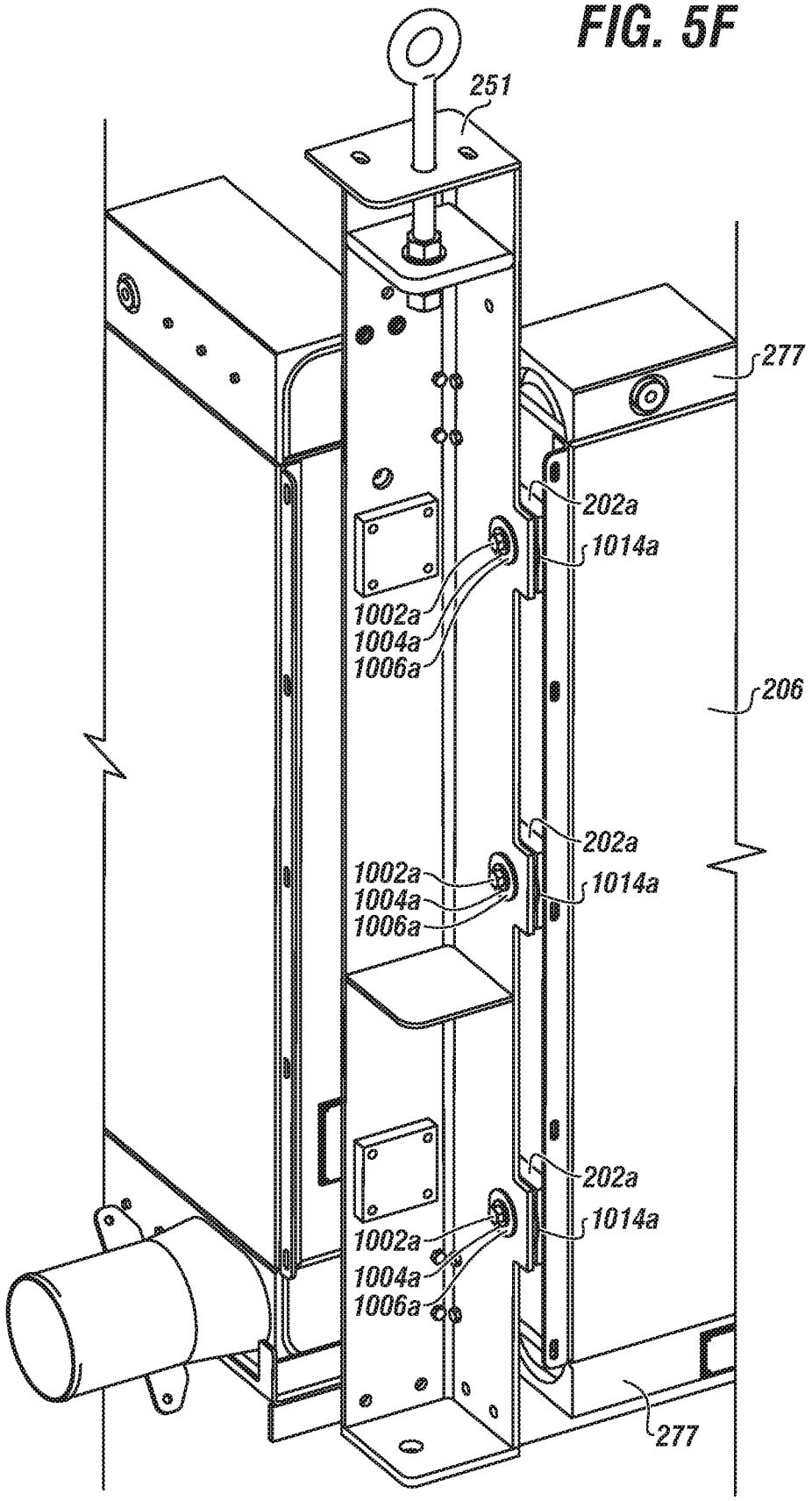
FIG. 5F shows a close-up view of a flex mount assembly used for coupling various components of a heat exchanger unit according to embodiments of the disclosure.

Referring now to FIGS. 5D, 5E, and 5F together, a component breakout view of a mount assembly, a side cross-sectional view of a mount assembly used with a bracket and a frame of a heat exchanger unit, and a close-up view of a radiator core mounted to a frame of a heat exchanger unit, respectively, in accordance with embodiments disclosed herein, are shown.

Any core 206 (or cooler) may be mounted to a frame 202 (or member(s) 250/251) with a flex mount 1000*a*. The flex mount 1000*a* provides for the ability to have one or more degrees of movement between the core(s) (206) and the frame 202, such as movement that may be caused by thermal expansion of the core. As shown, the flex mount 1000*a* may include various components including a bolt 1002*a*, a first washer 1004*a*, a top plate 1006*a*, an outer rigid ring 1008*a*, an inner rigid (spacer) ring 1012*a*, and a deformable ring 1010*b*, and a bottom (or back) plate 1014*b* (with plate slot 1014*c*). Although not shown here, the flex mount 1000*a* may be coupled to the frame 202 (or members 250 and/or 251) via a nut plate or threaded receptacle. Alternatively, the flex mount 1000*a* may be bolted or coupled with the respective cooler 204.

The cooler (or core 206) may have one or more core mounts or core mount brackets 287, which may each have one or more core mount slots 288.

As the flexible mount 1000*a* may be comparable to flexible mount 1000, flexible mount 1000*a* is only discussed in brevity. Of note, is the presence of one or more clearance regions 1018, which may promote or otherwise accommodate movement of the core 206 in one more vectors, such as illustrated by way of example via the directional arrows.

Figure 2D:
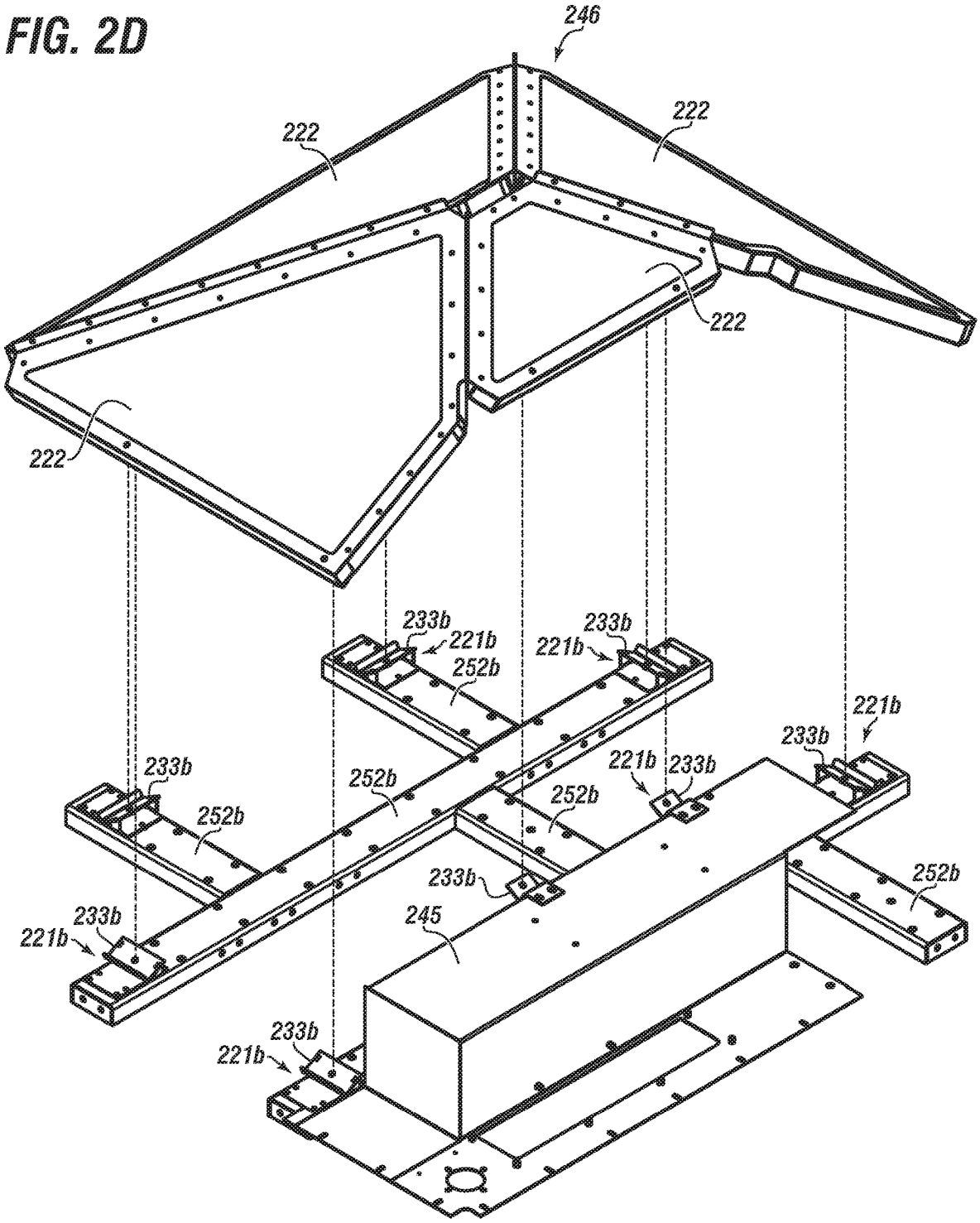
FIG. 2D shows an isometric view of a set of a plurality of baffles according to embodiments of the disclosure.
Figure 2E:
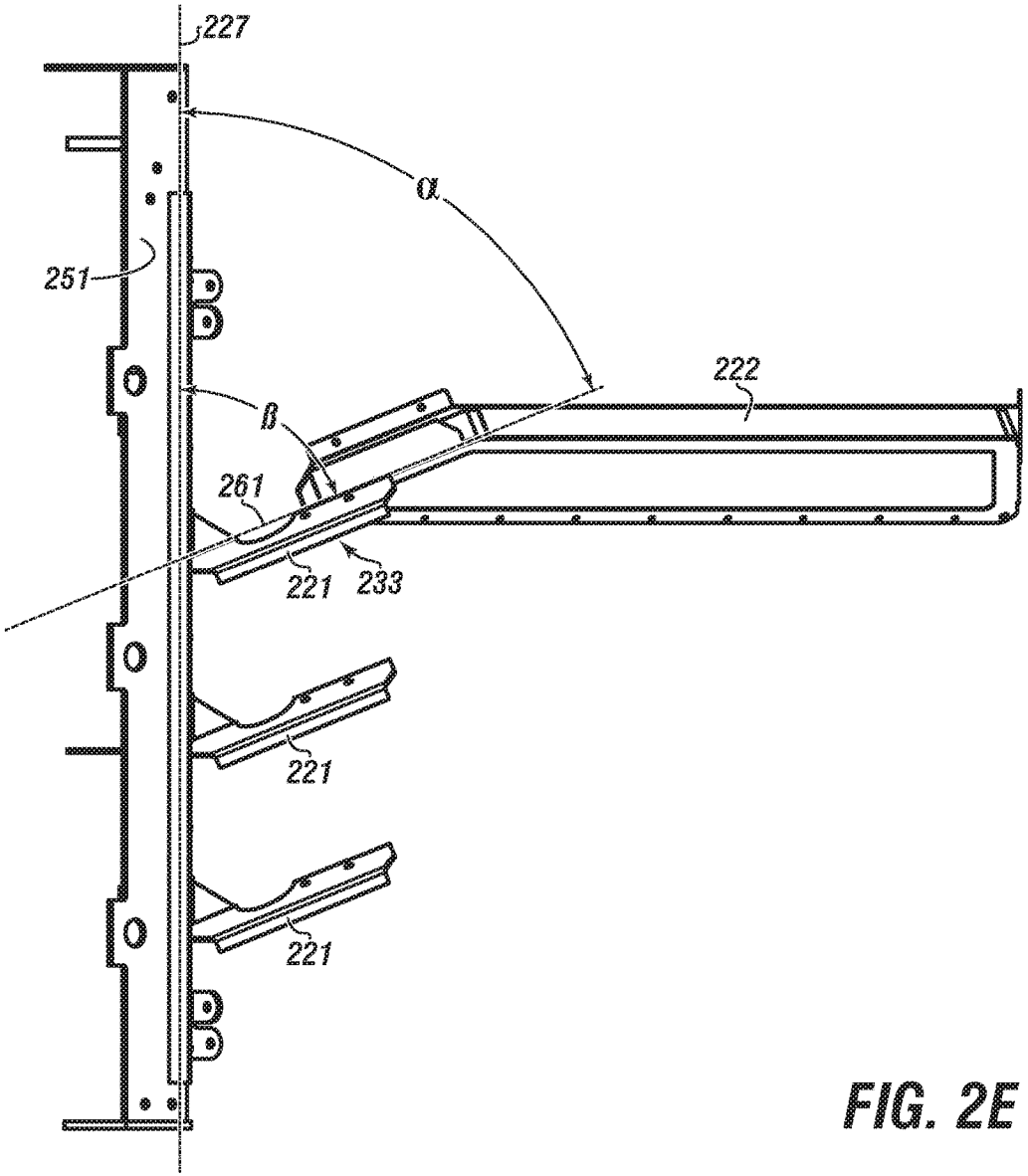
FIG. 2E shows a close-up partial side view of a baffle coupled to a vertical member according to embodiments of the disclosure.

Referring now to FIGS. 2C, 2D, and 2E together, a side cross-sectional view of an HX unit configured with a plurality of baffles, an isometric view of a set of a plurality of baffles, and a close-up partial side view of a baffle coupled to a vertical member, respectively, in accordance with embodiments disclosed herein, are shown.

Airflow through an HX unit 200 may be turbulent and otherwise chaotic. In addition, a fan 208 may be so loud in noise emission that it may be impossible to have a conversation between operators in an area of proximity near the fan 208 (or HX unit 200). In addition or the alternative, the noise from the fan 208 may exceed a regulation, which is of even greater significance in the event the HX unit 200 is used in or proximate to a residential setting.

As illustrated by way of example in FIG. 2C, the HX unit 200 may be configured with one or more baffles 222, which may be arranged or otherwise installed on a pseudo-interior side 229 of the unit 200 (the "exterior" 229*a* and "interior" 229 of the HX unit 200 may be thought of as positionally relative to where ambient air and heated air are).

Although numerous components around or proximate to an HGD (203, FIG. 2A) may be a source of noise, a fan 208 may produce a noise having dominant acoustic frequency 'f' with initial amplitude $A_i$. To reduce noise emitted from the fan 208, the HX unit 200 may be configured with one or more baffles 222 coupled to a frame 202. It was initially contemplated that the use of baffles 222 could be problematic (restrictive) to airflow; however, in field testing it was unexpectedly discovered that airflow through HX unit 200 had actually increased as a result of the presence of baffles 222. This synergistic effect is believed attributable to the baffles 222 (and position of the baffles) helping to streamline the airflow, rather than acting as a restriction.

Thus, instead of chaotic turbulence within the interior of the HX unit 200, a baffle shape and an angled orientation of the baffles 222 may result in smoothing out the transition of the airflow from generally horizontal to generally vertical, reducing the airflow recirculation within the interior of HX unit 200, and thus reducing restriction and increasing airflow. The angled orientation may allow for a wider baffle width, which when paired with the proper baffle spacing and absorption material, may work to reduce undesirous fan noise. Spacing may be done in a manner to account for a quarter wave length ($Q_1$-$Q_4$) of the fan noise.

While the baffles 222 may be shown herein as having a generally planar face 261, it will be understood that baffles 222 may have other shapes, such as curved (thus a non-planar face). The positioning of any baffle 222 herein may depend on an angle at which the respective baffle 222 is mounted, and will generally be at an angle $\alpha$ between 0 degrees to 90 degrees relative to the vertical axis (i.e., an angle defined by where a plane of face 261 intersects a vertical axis 227), as illustrated by way of example in FIG. 2E. In aspects, the angle $\alpha$ may be in the range of about 30 degrees to about 60 degrees. Dimensions of baffles 222 herein may be dependent upon variables, such as the size of the HX unit 200, proximity of other baffles 222, and the angle α of the baffle orientation, and may change from those depicted. The angle α of baffle orientation may help direct airflow into and toward the exhaust outlet 218*a*, such that air may be more easily drawn through the HX unit 200.

The dominant acoustic frequency f of the fan 208 may depend on the intended operating speed of the fan 208 and/or number of fan blades 211. The baffle(s) 222 may be designed, configured, and oriented (positioned) to optimize a reduction in amplitude of fan noise. One or more baffles 222 may be made to include or be fitted with a sound absorbing material 262. The material 262 may be mineral wool or another suitable material. The sound absorbing material 262 may be capable of reducing the level of at least the dominant acoustic frequency by 10 dB or more. In an analogous manner, the sound absorbing material may reduce the amplitude of the original fan noise.

One or more baffles 222 may be positioned approximately a quarter wavelength $Q_1$ below where the fan 208 is mounted. The quarter wavelength $Q_1$ may be calculated based on the dominant acoustic frequency f generated by the fan 208. By referring to a quarter wavelength distance, it will be understood that it may be a multiple of the quarter wavelength, i.e., at or close to the position at which the acoustic wavelength is at its maximum.

In the instance of using a plurality of sets of baffles 222, it may be desirous to arrange baffles 222 in sets positionable at the quarter wavelength (e.g., $Q_1$ to $Q_4$) of a different acoustic frequency in order to target different frequencies for acoustic damping. In this respect, baffles 222 of respective sets may be oriented at various angles $\alpha_x$. As the baffles 222 may be at varied angles $\alpha_x$, the entire face of the respective baffle 222 may not be at the same quarter wavelength position, which allows for some variation in the position of the baffles. Generally speaking, a baffle midpoint 224 of the baffle 222 may be positioned at the respective quarter wavelength position, but this may depend on the acoustic profile of the fan 208.

In aspects, there may be a first (or 'upper') set of baffles 263. One or more of the first set of baffles 263 may be configured in a manner whereby a first baffle plane 261 (respective to a first baffle planar surface) intersects the vertical axis 227 of the frame at an angle α. The angle α may be in the range of about 30 degrees to about 60 degrees. In embodiments, each baffle 222 of the first set of baffles 263 may be coupled to the frame 202 in a manner whereby the respective angle α of each of the first set of the baffles 263 is in the range of about 30 degrees to about 60 degrees. It is within the scope of the disclosure that the angle α of each respective baffle 222 of the first set of baffles 263 may be substantially similar; however, the angle α of each baffle 222 may also be varied with respect to the angles of the other baffles.

The sets of baffles may each have a respective angle α, such as $\alpha_1$ for the first set, $\alpha_2$ for the second set, etc. In aspects, the angle of each may be substantially the same, such as within about 1 to about 5 degrees.

The baffles 222 may be pivotablly connected directly to the frame 202. Alternatively, the baffles 222 may be fixedly connected to the frame 202, such as with a nut-bolt connection or weld. In this respect, one or more baffle mount couplers 221 may be connected to the frame 202 via coupling to multiple points of either or both of horizontal and vertical members 250, 251. In general, the vertical member 251 may have a plurality of baffle mount couplers 221 thereon. In aspects, each vertical member 251 may have in the range of about three to about five baffle mount couplers 221. The baffle mount coupler 221 may have a hole or slot configured to align with a corresponding frame hole or slot, whereby a bolt or pin from the baffle 222 may be inserted therethrough.

The HX unit 200 may be optimized for the greatest amount of sound absorption by taking into account variables such as the number of baffles 222, distance between baffles 222 (or sets of baffles), baffle length, and density of sound absorbing material.

As shown in FIG. 2D, a lower part (or bottom region) of the frame 202 may be defined by a plurality of horizontal members 250 and/or horizontal support plates 252*b*. Various support plates 252*b* may have one or more baffle mount couplers 221*b* installed or mounted thereon. The lower part of the frame 202 may be configured in a manner to accommodate various equipment, piping, ducts, or other structure within the HX unit 200, such as housing 245. Accordingly, baffles 222, such as baffles that are part of a lower set of baffles 246, one or more of which may be non-isosceles trapezoidal in shape, may also be configured in a manner to accommodate various equipment piping, ducts, etc.

The lower set of baffles 246 may include one or more asymmetrical baffles 222, with one or more of which that may be polygonal. The housing 245 may have one or more baffle mount couplers 221*b* installed or mounted thereon. Equipment and components in the lower part of the frame 202 may have a noise blocking material associated therewith. In aspects, the noise blocking material may be vinyl. The noise blocking material may be adhered to a respective surface. Other parts or components of HX unit 200 may include noise blocking material adhered thereto.

The baffle mount coupler(s) 221 may be integral to respective vertical member 251 (or other mountable structure, such as horizontal support plate 252*b*), or may be coupled therewith via rigid and sturdy connection, such as a weld, rivet, or other suitable manner. The baffle mount coupler 221 (or 221*b*) may include an extended baffle mount element 233 (or 233*b*) oriented to or at a predetermined angle β. In this respect, when the respective baffle 222 is coupled therewith, the baffle angle α may be substantially equal to the predetermined angle β, as shown by way of example in FIG. 2E.

The first set of baffles 263 may include in the range of about three to about five baffles 222. The first set of baffles 263 may be arranged in a generally symmetrical manner to each other, such that a first baffle 222 is associated with a first side region 242*a*, a second baffle 222 is associated with the second side region 242*b*, and so on. The configuration of the set of baffles may result in a first airflow region 230. As would be apparent to one of skill in the art, the volume of airflow in the first region 230 may be greater than at other regions, and thus a larger region 230 (relatively) may be desirous. FIG. 2C illustrates the sets of baffles may be configured in a manner whereby the positioning of baffles form a pseudo 'chevron' shape 220 (in cross-sectional) within the interior 229.

While baffle shape is not meant to be limited, and may vary amongst respective baffles of the first set of baffles 263, the baffle shape may be generally isosceles trapezoidal in nature. In this respect the baffles 222 of the first set 263 may have at least some minimal clearance with respect to each other upon installation and orientation within the HX unit 200.

There may be additional baffles 222, such as a second set of baffles 268, a third set of baffles 269, and so forth. The configuration of the second set of baffles 268 may result in a second airflow region proximate thereto, and similarly, the configuration of the third set of baffles 269 may result in a third airflow region proximate thereto.

While the number of baffles 222 (including sets of baffles) is not meant to be limited, there may be spatial and operational constraints and considerations. For example, too many baffles may result in inability for adequate airflow, and too few baffles may have no effect on negating unwanted noise.

At the same time, a sound absorbing material 262 (see also FIG. 3B) within the baffle(s) may provide the synergistic effect of reducing decibels of the noise attributable to operation of the fan 208. A person standing next to a fan and radiator may not be able to have an audible conversation with another person standing relatively adjacent thereto, as the loudness may be in excess of 70 dBs. In contrast, beneficially the operation of the HX unit 200 configured with the baffles 222 in accordance with embodiments of the disclosure results in significantly reduced noise whereby person-to-person conversation in the proximate vicinity of the HX unit 200 is possible. The reduced loudness may be in the range of about to 20 dB's to about 65 dB's.

Accordingly, the HX unit 200 may include the second set of baffles 268, each of the second set of baffles configured at an angle α to the vertical axis 227. While not meant to be limited, the angle α of any of the baffles 222 may be in the range of about 0 degrees to about 90 degrees. In aspects, the angle α of any of the baffles 222 of the second set of baffles 268 may be in the range of about 30 degrees to about 60 degrees. Each of the second set of baffles 268 may be connected to the frame 202 in a manner comparable to that of the first set 263. As such, the second set of baffles 268 may be connected to respective baffle mount couplers 221.

The HX unit 200 may include additional sets of baffles, such as a third set of baffles, fourth (or 'lower') set of baffles, and so forth. Each and every baffle of any respective set of baffles may be coupled to the frame 222 via the respective and corresponding baffle mount couplers. Each of the third set of baffles 269 may be configured with an orientation at an angle α to the vertical axis 237. That is, each respective baffle 222 of the third set 269 may have a plane 261 that intersects the vertical axis 237 at the angle α. The angle α may be in the range of about 30 to about 60 degrees.

It is within the scope of the disclosure that respective baffles of any particular set of baffles may be asymmetrical. Thus, as an example, one or more of the baffles of the first set of baffles may be generally isosceles trapezoidal in shape, while the remaining baffles of the first set are not (i.e., the remaining baffles are other quadrilateral in shape, polygonoal, hemispherical, and so on). The shape of the baffle may need to made to account other internals of the HX unit 200, such as piping, ducts, other subcomponents, etc. (e.g., housing 245, FIG. 2D).

In aspects, the HX unit 200 may include four sets of baffles. One or more, including all, baffles 222 may have a respective plane 261 (associated to an effective planar baffle face surface). The respective plane 261 may intersect the vertical axis 227 at an angle α in the range of about 0 to about 90 degrees. In aspects, the respective angle α may be in the range of about 30 to about 60 degrees.

The core(s) 206 may be coupled to the frame 202 in accordance with embodiments disclosed herein, including directly, or indirectly via mounting a cooler 204 to the frame 202. The cooler 204 may include the core 206 and a tank. The core(s) 206 may include one or more tanks (such as inlet tank 277 and outlet tank 280) welded thereto. The inlet tank 277 may be associated with a tank inlet 278. Similarly, the outlet tank 280 may be associated with a tank outlet 284.

As shown in the drawings and as would be understood by one of skill in the art, each set of baffles may have a respective first baffle associated with a first side region of the HX unit 200. As it follows, each set of baffles may have a respective second baffle associated with a second side region of the HX unit 200, a respective third baffle associated with a third side region, respective fourth baffle associated with a fourth side region, and so on.

Figure 3A:
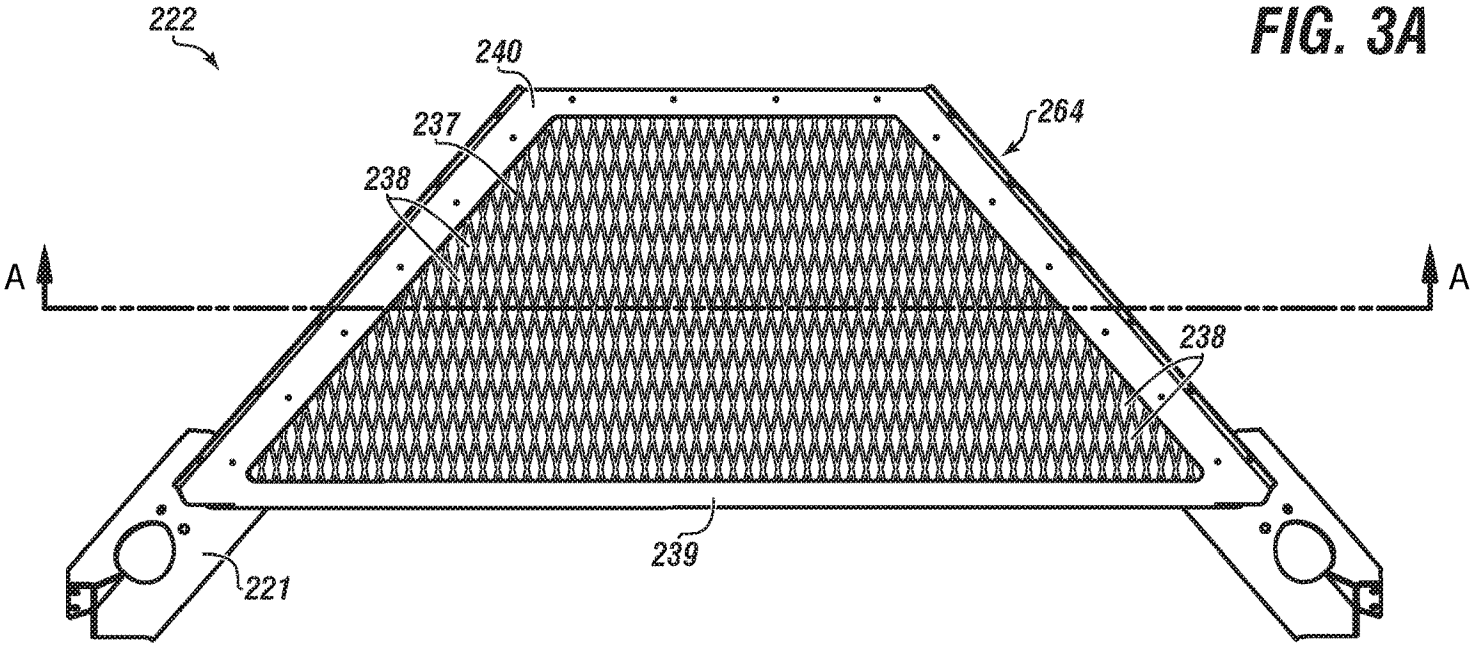
FIG. 3A shows an isometric view of a baffle according to embodiments of the disclosure.
Figure 3B:
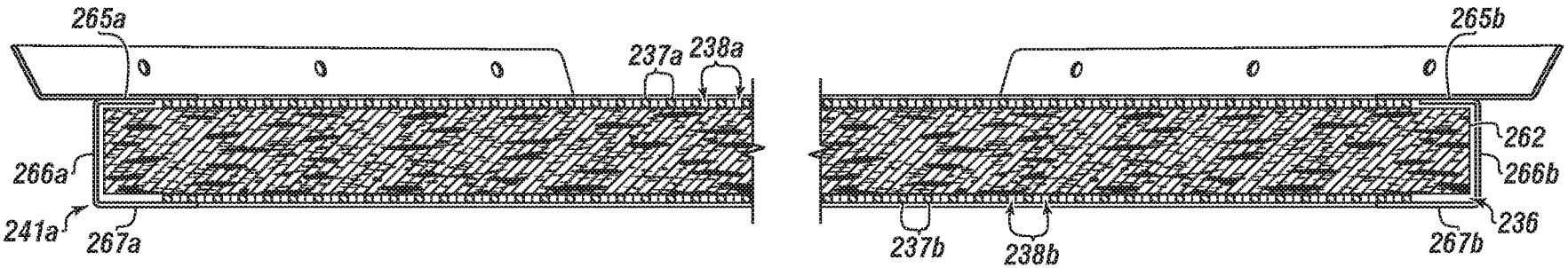
FIG. 3B shows a lateral cross-sectional view of a baffle according to embodiments of the disclosure.

Referring now to FIGS. 3A and 3B together, an isometric view of a baffle, and a lateral cross-sectional view of a baffle, respectively, in accordance with embodiments disclosed herein, are shown. As illustrated by way of example, the baffle (including any baffle of the disclosure) 222 may include one or more rigid members 237. The rigid member 237 may be a mesh. The mesh 237 may include various cross-linking or interconnected structure that may result in a plurality of orifices or openings 238. The orifices 238 may be in the range of about 0.1 inches to about 2 inches in mesh size.

The baffle 222 may include a baffle frame 264. The baffle frame 264 may be a unitary piece, or the combination of multiple subpieces. As shown, the baffle frame 264 may have a generally elongated linear member 239, as well as a non-linear member 240 (as a result of a curve, plurality of linear segments, bend, etc.). While other shapes are within the scope of the disclosure, one or both of the elongated member 239 and the non-linear member 240 may have a generally u-shape cross-sectional 241, as shown in FIG. 3B.

As such, each of the elongated member 239 and the non-linear member 240 may have a first side 265 *a, b*, a middle 266 *a, b*, and a second side 267 *a, b*, respectively. There may be a first mesh 237*a* connected to the first side 265*a* of the elongated member 239 and the corresponding first side 265*b* of the non-linear member 240. In a similar manner, there may be a second mesh 237*b* connected to the second side 267*a* of the elongated member 239 and corresponding second side 267*b* of the non-linear member 240.

The mesh 237 *a, b* may be connected to the members 239, 240 in a secured or other fixed manner, such as weld or other suitable form of attachment. As shown in FIG. 3B, the baffle 222 may form an effective enclosure or have a resultant baffle chamber 236. The baffle chamber 236 may be filled with a material 262, which may be sound absorbing. The material 262 may be mineral wool, such as a mineral wool product provided by Roxul, Inc. (subsidiary of Rockwool International). The material 262 may have other characteristics, such as non-combustible, high melting point, fire retardant, hypoallergenic, and chemically inert, any of which may be useful for the environment associated with a HGD (e.g., 203, FIG. 2A). The material 262 may be a 'green' material made from recycled materials.

While the baffle 222 may be constructed and otherwise completed prior to insertion of the material 262, ease of insertion of the material 262 may be achieved prior to final construction. For example, the first mesh 237*a* may be welded to the first side 265*a* of the non-linear member 239, then the second mesh 237*b* may be welded to the second side 267*a* of the linear member 239, and then the material 262 may be inserted into chamber 236. Once the material 262 is inserted, each side 265*b* and 267*b* the non-linear member 240 may be correspondingly welded with the first and second mesh.

One or more, including all, baffles 222 may include the material 262. The presence of the sound absorbing material may contribute to a reduction of the loudness of the dominant acoustic frequency of the fan by at least 10 dB. At least one of the sets of baffles may be positioned approximately a quarter wavelength below the fan mounted to the outlet. The quarter wavelength may be calculated based on the dominant acoustic frequency (f) generated by the fan (208).

One of ordinary skill in the art would appreciate that embodiments herein provide for an improved heat exchanger unit of the present disclosure that need not have one or more baffles therein.

Figure 4A:
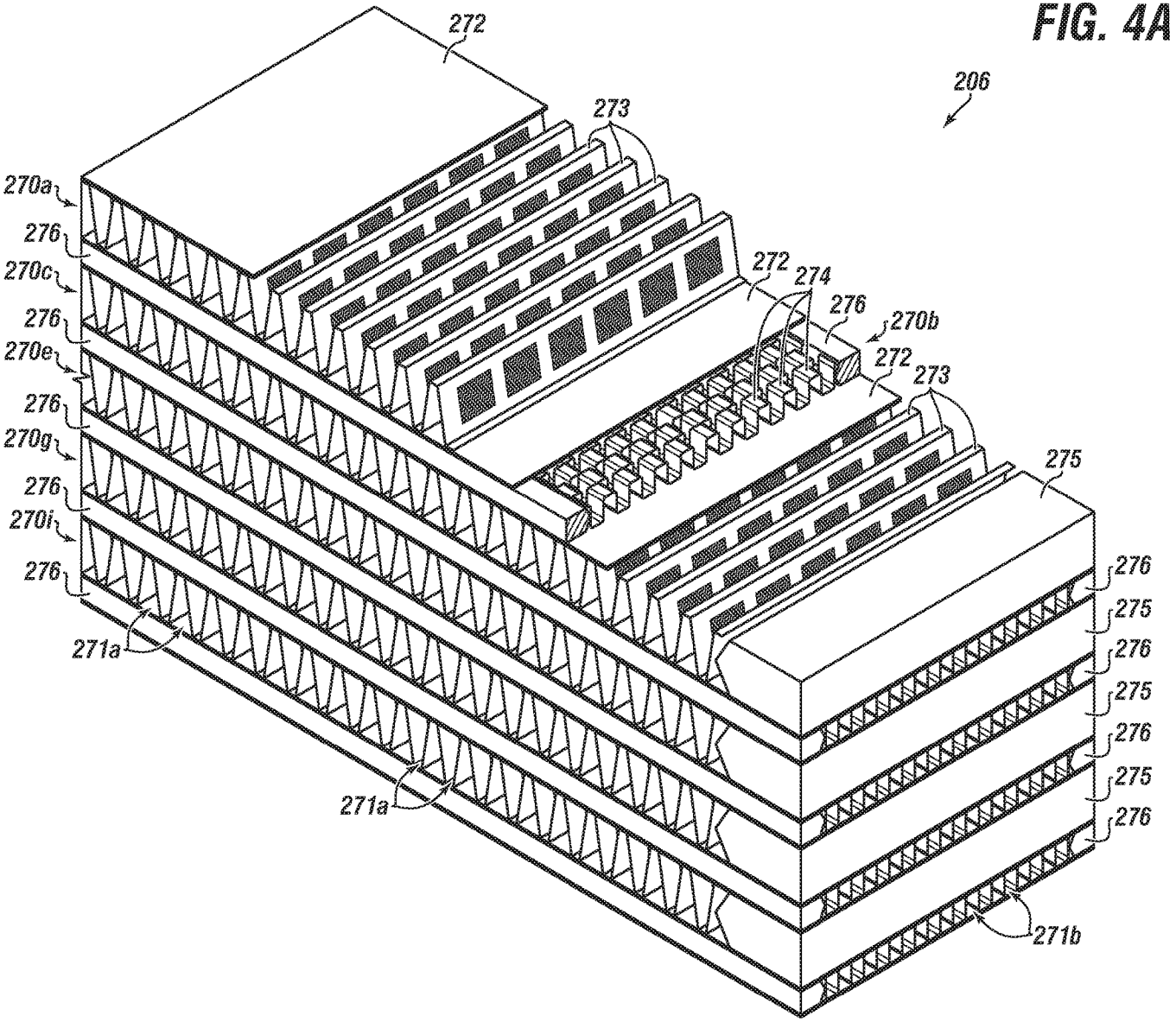
FIG. 4A shows an isometric partial view of a radiator core according to embodiments of the disclosure.
Figure 4C:
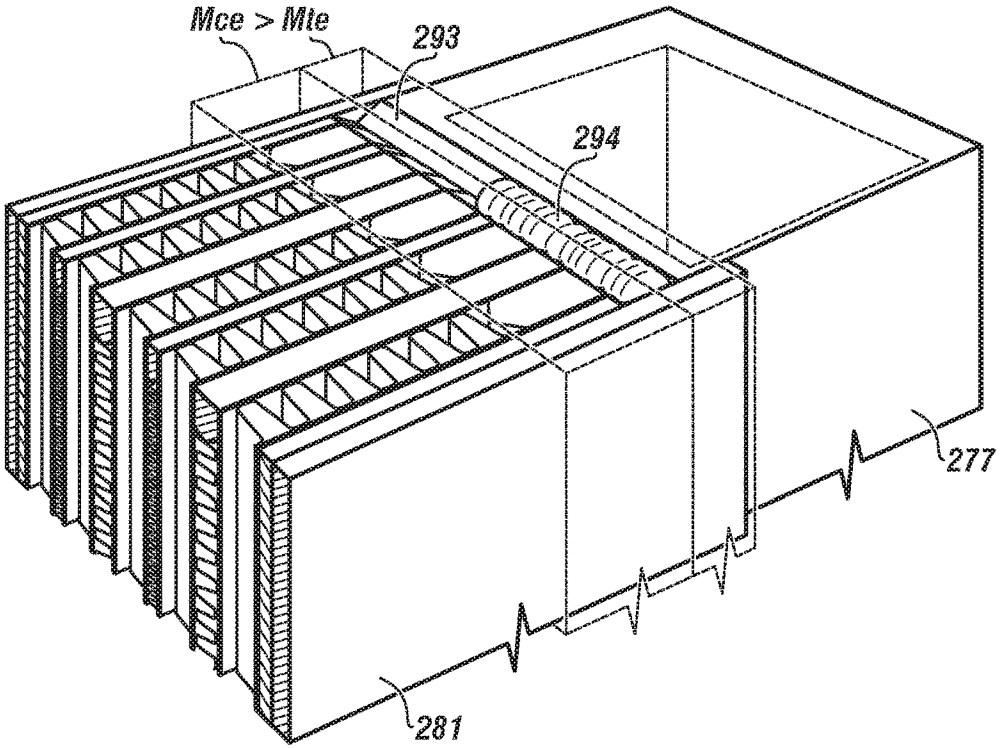
FIG. 4C shows a view of a tank welded to a core according to embodiments of the disclosure.
Figure 4B:
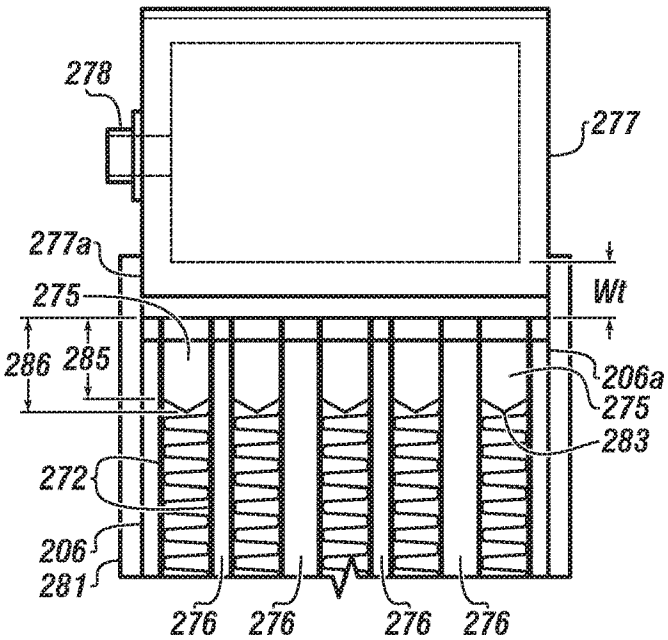
FIG. 4B shows a partial close-up downward view of an end of a radiator cooler having a tank and a core according to embodiments of the disclosure.

Referring now to FIGS. 4A, 4B, and 4C together, an isometric partial view of a radiator core, a close-up downward view of a tank welded to a core, and an isometric view or a core end welded to a tank end, respectively, in accordance with embodiments disclosed herein, are shown. A radiator core 206 for an HX Unit (e.g., 200) may include a structure formed from stacked layers 270 *a, b*, etc. of corrugated fin elements. Each layer 270 may be mounted or otherwise arranged in manner so that channels 271*a* formed by the fins in one layer 270*a* lie in transverse (or albeit sometimes parallel) relation to the channels 271*b* formed by the fins in adjacent layers 270*b*, whereby fluid flow passing through the channels may be in cross-flow or counterflow relation in alternate layers.

While only some layers of the core 206 are shown, various numbers of finned layers may be similarly stacked for completing the core 206, the number of layers depending on the particular application.

A parting sheet 272 may be placed between adjacent layers to maintain separation between alternate fluid flow paths, and an outer cover bracket(s) 281 may also be used, including for structural support. The cover bracket 281 may be similar to the parting sheets 272, but of thicker stock for added strength. The cover brackets 281 may be brazed to the core 206 (or parts of core 206, such as sheets 272) on each respective side.

In aspects, the core 206 may be a structure in which a first fluid passes through alternate layers of the core in one direction and a second fluid passes through the remaining layers in a direction perpendicular to the first fluid.

The core 206 may include external fins 273, which may be associated with each layer where airflow passes therethrough. The core 206 may include internal fins 274, which may be associated with each layer where a HGD utility fluid F passes therethrough.

The fin elements of layers 270 *a, b* may be made of aluminum, or other material suitable for heat transfer, including copper, brass, steel, and composite. In aspects, the fins may be made of 3003 aluminum. Each layer 270 may have a fin density of about 4 to about 30 fins per inch. In aspects, layers 270 of the external and internal fins 273, 274 may have in the range of about 10 to about 15 fins per inch.

In manufacture, the layers 270 of fins may be laid alternatingly transverse to each other between parting sheets 272, and fitted with respective header bars 275 and face bars 276. A brazing material may be placed between respective sheets 272 and bars 275, 276. The brazing material may be 4004 aluminum, or other comparable material.

The layers are pressed and held together, and then placed into a brazing oven (or heating furnace, etc.). The brazing operation is finished by taking out the core from the oven, and then cooled. The brazing may be controlled with time and temperature. The assembled unit may be a 'core' 206.

The core 206 may be part of a cooler 204 (or cooling circuit). There may be an inlet tank 277 and an outlet tank (not shown here), which may be welded to a core end 206*a* of the core 206. The tank 277 may be welded in a manner whereby a HGD utility fluid F may flow therein, and into respective layers 270*b* of internal fins 274. Although not shown here, the inside of inlet tank 277 may be divided by one or more partition walls or plates, for which fluid may flow therein. The inlet tank may have one or more tank inlets 278. The tank inlets 278 may be configured in a manner whereby a fluid may be transferred into the tank 277 via the inlets 278. Various piping, tubing, etc. may be connected to the tank inlets 278, as may be desired for a particular application, and as would be apparent to one of skill in the art. Fluid may be generally evenly distributed through the respective channels 271 as a result of inherent resistance from the fin stack configuration.

With brief additional reference to FIG. 2A, in operation, a utility fluid F from HGD 203 may be transferred into the HX unit 200. The transfer may be direct or indirect (such as from a holding tank). Within the unit 200, the fluid may flow into a tank chamber (not shown) via inlet 278 of inlet tank 277. The fluid then distributes into the various alternating layers 270 *b*, etc. and respective channels 271*b*.

Similarly airflow 216 may be drawn into HX unit 200, and into the various perpendicular and alternating layers 270 *a*, etc. and respective channels 271*a*. The HX unit 200 may be configured for passing atmospheric air through or in contact with the core 206, so as to reduce the temperature of the service fluid circulated through the core 206. In this respect, a fan (or fan system) 208 may be rotatable about a fan axis so as to draw in (or suction, etc.) atmospheric air inwardly through channels 271*a*, resulting in airflow through the core 206. The fan 208 may operate in a manner whereby airflow may move in a generally horizontal direction from external of the core 206, through the core 206, and into the interior of the HX unit 200, whereby the heated air then may transition to a generally vertical direction and out as exhaust 218.

The service fluid $F_{1\text{-}hot}$, having a temperature hotter than the airflow, may be cooled (and conversely, the airflow warms). Cooled service fluid $F_{1\text{-}cold}$ leaves the cooling circuit via a fluid outlet 284. Various piping, tubing, etc. may be connected to the tank outlet 284, as may be desired for a particular application, and as would be apparent to one of skill in the art. In some aspects, the tank outlet 284 may be in fluid communication with an inlet of a subsequent cooling circuit also connected with the frame 202.

Cooled utility fluid may be returned from the HX unit 200 to a source tank, or directly to the HGD 203. Thus, service fluid from the heat generation unit 203 may be circulated in a cooling circuit in a systematic and continuous manner. As will be appreciated, a suitable circulating pump (not shown) may be provided to circulate the service fluid through the core cooler 204.

Header bars 275 and face bars 276 may be mounted adjacent to the sides of fins 274 and 273, respectively, the bars being brazed between the extending ends of the parting sheets 272. The face bars 276 may be coupled parallel to the channels 271*b* and serve to block the sides of the channels to prevent fluid leakage, add structural stability and strength to the core 206, and provide a structure to which the tanks may be welded.

To direct the fluid flow into the channels, tanks may be welded to the core 206 at the fluid inlet side 206*a*, or the fluid outlet side, or commonly both sides. Since the core 206 (including the fins), parting sheets, and bars are normally joined by brazing, welding the tanks directly to the core 206 may be of concern as the welding temperature may be about or in excess of 1200° F. These temps may leave the core 206 distorted, and promote flow and leaching of the braze alloy.

The bars 275, 276 may have a respective bar length 286, which may include pointed extension 283. Thus the bar 275 or 276 may have an effective brazing length 285. Accordingly, at least some or all of the brazing material between the bar and respective parting sheet may heat, and even partially melt during a weld process; however, the brazing length 285 is sufficient enough to prohibit or deter flow of the brazing material, and after weld heat is removed, the braze resolidfies in place.

In essence, the bars 275 and 276 are part of a core end 206*a*, which has an effective core end mass Mce approximately defined by the mass within region Mce. Mce may be determined by mass within a volume (e.g., brazing length 285×fin stack height×core width). In a similar respect the tank (277, 280) has a tank end 277*a*, which has an effective tank end mass Mte within region Mte. Mte may be defined by a volume of material at the tank end (e.g., tank wall thickness×tank length×tank width). The effective core end mass Mce may be greater than the effective tank end mass Mte. This may provide the ability so that whereby when the tank is welded to the core there is a natural barrier within the core (as a result of its increased mass) that prevents leaching or flowing of the brazing material. And where maybe some of the brazing material becomes molten or gooey, this portion of material may be held in situ by the part of the brazing material that remains solid.

The tank end 277*a* may be welded to the core end 206*a*. The weld 293 may be any desired weld suitable and known to one of skill in the art for welding a tank to a core. In embodiments, the weld 293 may be a v-groove weld. Weld material 294 may be used to accomplish the weld.

Other coolers 204 (e.g., 204 *b, c, d*, etc.) may be generally similar in nature, and suitably configured for the cooling of various service fluids from the heat generation device 203.

Advantages

Embodiments of the disclosure advantageously provide for an improved heat exchanger unit useable with a wide array of heat generating devices. The heat exchanger unit of the disclosure may provide for the ability to reduce sound attributable to a point source, such as a fan. The fan may have a dominant acoustic frequency that may be reduced by at least 10 decibels. The heat exchanger unit may be configured with a particular baffle configuration that helps reduce sound. The baffles may be configured to have or contain a sound absorbing material. At the same time the baffle configuration may help drastically improve streamlined airflow, which further helps reduce sound emission and improves overall efficiency of the heat exchanger unit because of lowered power requirements.

The heat exchanger unit may advantageously provide for the ability to simultaneously cool multiple utility fluids in parallel.

Advantages of the disclosure provide for a compact design with more heat transfer area in limited space, more heat transfer capability, reduced overall height by arranging heat exchanger cores at all four sides in general cube shape.

Embodiments of the disclosure advantageously provide for the ability to improve structural integrity of a heat exchanger unit. A radiator core of the unit may have an increased mass on a core end that may substantially prohibit or eliminate runoff of brazing material during a welding process.

The heat exchanger unit may provide for the ability to provide an 'absorber' effect with any thermal expansion. That is, one or more components may be coupled together via the use of a flex amount assembly, the assembly having a deformable member associated therewith. As thermal expansion occurs, the deformable member may deform resulting to absorb the expansion motion or stress. Advantages herein may provide for a more convenient and realizable welding practice for core and tank, and a more convenient and flexible mount assembly.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure presented herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of any claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A heat exchanger unit, comprising:

a frame comprising a top region, a bottom region, and a plurality of side regions;

a plurality of coolers, each of the plurality of coolers coupled with the frame proximate to a respective side region, each of the plurality of coolers having an outer surface and an inner surface, and at least one of the plurality of coolers comprising a tank end welded to a core end, wherein a tank end mass of a tank end volume is less than a core end mass of a core end volume; and a mount assembly for coupling at least one of the plurality of coolers to the frame, the mount assembly further comprising:

an elongated fastening member;

a rigid outer ring;

a rigid inner ring; and a deformable ring disposed between the rigid outer ring and the rigid inner ring, wherein the elongated fastening member extends through the rigid inner ring and at least partially into the frame.

2. The heat exchanger unit of claim 1, further comprising:

a vertical axis;

an airflow region within the heat exchanger unit; and a first set of baffles, each of the first set of baffles configured at a first angle to the vertical axis.

3. The heat exchanger unit of claim 2, further comprising:

a second set of baffles, each of the second set of baffles configured at a second angle to the vertical axis; and a third set of baffles, each of the third set of baffles configured at a third angle to the vertical axis.

4. The heat exchanger unit of claim 3, wherein the first set of baffles, the second set of baffles, and the third set of baffles each comprise four baffles, wherein each baffle of the first set of baffles, the second set of baffles, and the third set of baffles comprises a sound absorbing material, and wherein each of the first angle, second angle, and third angle is in a range of 30 to 60 degrees.

5. The heat exchanger unit of claim 1, further comprising:

a fan mount bar extending between one of the plurality of side regions and another of the plurality of side regions; and a fan mounted to the fan mount bar, the fan further comprising a motor and a plurality of fan blades in a range of 8 to 12.

6. The heat exchanger unit of claim 1, wherein each of the plurality of coolers are configured to permit airflow to pass therethrough, and wherein operation of a fan results in airflow through each of the plurality of coolers, into an airflow region, and out of an exhaust outlet.

7. The heat exchanger unit of claim 1, wherein a weld between the tank end and the core end is a v-groove weld.

8. A heat exchanger unit, comprising:

a vertical axis;

a frame comprising at least one side region;

at least one cooler coupled with the frame proximate to the respective side region, the at least one cooler comprising a tank end welded to a core end, wherein a tank end mass of the tank end is less than a core end mass of the core end; and a mount assembly for coupling the at least one cooler to the frame, the mount assembly further comprising:

an elongated fastening member;

a rigid outer ring;

a rigid inner ring; and a deformable ring disposed between the rigid outer ring and the rigid inner ring, wherein the elongated fastening member extends through the rigid inner ring and at least partially into the frame.

9. The heat exchanger unit of claim 8, further comprising:

a first set of baffles, each of the first set of baffles configured at a first angle to the vertical axis, and at least one baffle of the first set of baffles comprises a sound absorbing material;

a second set of baffles, each of the second set of baffles configured at a second angle to the vertical axis; and a third set of baffles, each of the third set of baffles configured at a third angle to the vertical axis wherein each of the first angle, the second angle, and the third angle are in a range of 30to 60 degrees.

10. The heat exchanger unit of claim 9, further comprising:

a tubular fan mount bar;

a shroud coupled to a top surface of the frame;

an aeroring; and a fan mount coupled to the tubular fan mount bar; and a fan coupled to the fan mount, the fan further comprising a hydraulic motor.

11. The heat exchanger unit of claim 10, wherein the hydraulic motor is powered by a pressurized hydraulic fluid pressurized to a range of 2000 to 6000 psi, and wherein at least one of the first, second, or third set of baffles is positioned a quarter wavelength below the fan, the quarter wavelength being calculated based on a dominant acoustic frequency generated by the fan.

12. The heat exchanger unit of claim 8, wherein a weld between the tank end and the core end is a v-groove weld, and wherein the mount assembly further comprises: a top plate, a bottom plate, and a washer.

13. A heat exchanger unit, comprising:

a frame comprising a top region, a bottom region, and a plurality of side regions;

a plurality of coolers, each of the plurality of coolers coupled with the frame proximate to a respective side region, and each of the plurality of coolers comprising a core welded with a tank; and an airflow region within the heat exchanger unit;

wherein each core further comprises a core end having a core end mass associated with a core end volume of material, wherein each tank further comprises a tank end having a tank end mass associated with a tank end volume of material, and wherein each core end mass is greater than each respective tank end mass.

14. The heat exchanger unit of claim 13, further comprising:

a mount assembly for coupling at least one of the plurality of coolers to the frame, the mount assembly comprising:

an elongated fastening member;

a rigid outer ring;

a rigid inner ring;

a deformable ring disposed between the rigid outer ring and the rigid inner ring, wherein the elongated fastening member extends through the rigid inner ring and at least partially into at least one of the frame, an associated vertical member, an associated horizontal member, or combinations thereof.

15. The heat exchanger unit of claim 14, further comprising:

a first set of baffles, each baffle of the first set of baffles configured at an angle to a vertical axis, and each of the first set of baffles comprising a sound absorbing material;

a second set of baffles, each baffle of the second set of baffles configured at a second angle to the vertical axis; and a third set of baffles, each baffle of the third set of baffles configured at a third angle to the vertical axis.

16. The heat exchanger unit of claim 13, further comprising:

a first set of baffles, each baffle of the first set of baffles configured at a first angle to a vertical axis;

a second set of baffles, each baffle of the second set of baffles configured at a second angle to the vertical axis; and a third set of baffles, each baffle of the third set of baffles configured at a third angle to the vertical axis, wherein the first set of baffles, the second set of baffles, and the third set of baffles each comprise four baffles, and wherein each baffle of the first set of baffles, the second set of baffles, and the third set of baffles comprises a sound absorbing material.

17. The heat exchanger unit of claim 16, wherein each of the first set of baffles are generally isosceles trapezoidal in shape, wherein the sound absorbing material comprises mineral wool, and wherein each of the first angle, second angle, and third angle is in a range of 30 to 60 degrees.

18. The heat exchanger unit of claim 17, wherein each of the plurality of coolers are configured to permit airflow to pass therethrough, and wherein operation of a fan results in airflow through each of the plurality of coolers, into the airflow region, and out of an exhaust.

19. The heat exchanger unit of claim 13, further comprising:

a tubular fan mount bar coupled between one of the plurality of side regions, and another of the plurality of side regions;

a fan mount coupled to the tubular fan mount bar; and a fan coupled to the fan mount, the fan further comprising a hydraulic motor, wherein the fan is operable to pull airflow through the plurality of coolers and into the airflow region.

* * * * *